US005315360A

United States Patent [19]

Yamauchi et al.

[11] Patent Number: 5,315,360

[45] Date of Patent: May 24, 1994

[54] COPYING MACHINE FOR COPYING A ONE-SIDE SUBJECT COPY ON BOTH SIDES OF A COPYING SHEET

[75] Inventors: Yasuji Yamauchi; Yuji Okamoto, both of Nara, Japan

[73] Assignee: Sharp Kabushiki Kaisha, Osaka, Japan

[21] Appl. No.: 764,684

[22] Filed: Sep. 20, 1991

[30] Foreign Application Priority Data

Sep. 28, 1990 [JP] Japan ..... 2-264222

[51] Int. Cl.[5] ..... G03G 15/00

[52] U.S. Cl. ..... 355/319; 355/204; 355/308; 355/318; 271/264

[58] Field of Search ..... 355/204, 308, 309, 319, 355/318, 316, 317, 321; 271/3.1, 9, 12, 264

[56] References Cited

U.S. PATENT DOCUMENTS

| | | | |
|---|---|---|---|
| 4,330,197 | 5/1982 | Smith et al. . | |
| 4,607,948 | 8/1986 | Naito | 355/319 X |
| 4,650,313 | 3/1987 | Koike | 355/319 |
| 4,980,729 | 12/1990 | Okamoto | 355/318 X |
| 5,016,061 | 5/1991 | Tashiro et al. | 355/318 X |

*Primary Examiner*—A. T. Grimley
*Assistant Examiner*—Sandra L. Brasé
*Attorney, Agent, or Firm*—David G. Conlin; Robert F. O'Connell

[57] ABSTRACT

A copying machine capable of continuously copying two or more one-side subject copies on both sides of copying sheets, includes a rotary drum housing (32) for passing two or more subject copies through a light scan window (43) of an optical system (35), a paper cassettes (52) disposed in the rotary drum housing for feeding the copying sheets to the optical system, a reversing roller (62) coupled to the rotary drum housing for reversing the copying sheets having images formed by the optical system on one sides, a middle tray (55) coupled to the rotary drum housing for refeeding the reversed copying sheets to the optical system, sensors (S1-Si) connected to the rotary drum housing for detecting a number of the subject copies passing through the rotary drum housing, and a microcomputer (103) connected to the rotary drum housing for controlling the rotary drum housing so that the subject copies pass through the light scan window of the optical system sequentially in circulation from a final page to a first page. The control unit includes a rotary drum (76) for copying the final subject copy, one previous subject copy with respect to the final subject copy, and every other subject copy following the previous subject copy on the copying sheets sequentially fed from the paper cassettes at a first circulation in case of the numbers of the subject copies detected by the sensors are odd.

16 Claims, 16 Drawing Sheets

COPYING MACHINE FOR COPYING A ONE-SIDE SUBJECT COPY ON BOTH SIDES OF A COPYING SHEET

BACKGROUND OF THE INVENTION

1. Field of the Invention

The present invention relates to a copying machine which includes a rotary drum housing (referred to as RDH) served as a circulating type subject copy feeding unit for sequentially circulating two or more subject copies (i.e., sheets depicting graphic materials such as pictures, writing, and printing) as those materials being passed an optical scanning point and a sheet refeeding unit for refeeding copying sheets each having a copied image on one side so that the image on one side of the copying material is copied on both sides of each copying sheet.

2. Description of the Related Art

The inventors of the present invention know that there is a copying machine adapted to copy an image formed on one side of a subject copy on both sides of a copying sheet.

The above-mentioned known copying machine includes a RDH which is so arranged that it feeds a subject copy to an optical scan point in a sequentially circulating manner from a final page of subject copies. In a case that the number N of the subject copies is odd, the RDH serves to feed the (N−1) th page of one previous to the final page N and the every other page following the (N−1) th page, that is, (N−1) th page, (N−3) th page, (N−5) th page, . . . , fourth page, and second page (even pages) so that those subject copies are respectively copied on the copying sheets. The copied sheets are temporarily stored in a middle tray. This is a first circulation.

Then, starting a second circulation, the Nth page, that is, the final page is copied on a non-use copying sheet. This non-use copying sheet is ejected to a paper tray. In succession, the copying sheets having a copied image on each one side are fed from the middle tray in a paper-reversed manner so that the remaining pages (N−2) th page, (N−4) th page, . . . , third page, and first page (odd pages) are copied on the non-use sides of those copying sheets. The resulting copying sheets, that is, the sheets having the images on both sides are ejected to a paper tray as disclosed in Japanese Patent Lying-open No. 56-17359.

On the other hand, in a case that the number N of the subject copies is even, during the first circulation, the final page and the every other page following the final page (even pages) are respectively copied on the copying sheets and are stored in the middle tray. In succession, during the second circulation, the (N−1) th page, that is, one previous to the last page and the every other page following the (N−1) th page (odd pages) are copied on the non-use sides of those copying sheets fed from the middle tray and are ejected to the paper tray.

Assuming that the number of the subject copies is five, the foregoing copying process will be described with reference to FIGS. 1 to 9 in more details.

With reference to FIG. 1, the schematic construction of the copying machine 10 will be described. The RDH 11 provides a subject-copy platform 12 on which the subject copies D1, D2, . . . , D5 are laminated in a manner to direct the sides having images I1, I2, . . . , I5 downwardly and to place the final page D5 at the uppermost location.

The subject copies D5, D4, . . . , D1 are fed to a rotary drum 13 through a feeding mechanism (not shown). Those subject copies are reversed through the effect of a reversing mechanism 14 and then are fed to a rotary drum 15. Then, the subject copies are returned to the lowermost location of the subject-copy platform 11 through the effect of the feed-back section (not shown).

Under the RDH 11, a photosensitive drum 16 is located for transferring the images I1, I2, . . . , I5 on the copying sheets P1, P2, . . . , P5. Copying sheets P1, P2, . . . , P5 are fed from a paper cassette 17 to the photosensitive drum 16 through a sheet-feeding belt 18. The copied sheets P1, P2, . . . , P5 are ejected to the paper tray 19 or temporarily stored in the middle tray 20 through the reversing mechanism 21. The reversed sheets P1, P2, . . . , P5 are again fed to the photosensitive drum 16 through a feed-out belt 18.

In copying one side of the subject copy, the light scanning on the subject copy is carried out under the rotary drum 15.

When five subject copies D1, D2, . . . , D5 are copied on both sides of the copying sheets, as shown in FIG. 2, the subject copies are respectively fed to the rotary drum 15 from the final page. The rotary drum 15 is a light scanning place. In this case, no light scanning is carried out on the final page, that is, the fifth page D5. The fifth page D5 is skipped and is returned to the subject-copy platform 12. Then, when the fourth page D4 is passed through the rotary drum 15, the light scanning is carried out on the image I4 so that the image I4 is copied on the first copying sheet P1 fed from the paper cassette 17 (see FIG. 3).

Then, as shown in FIG. 4, the copying sheet P1 is temporarily ejected to the middle tray 20 through the reversing mechanism 21. In the meantime, the third subject copy D3 is skipped without being copied and the image I2 of the second subject copy D2 is copied on the second copying sheet P2.

The first subject copy D1 is skipped without being copied. Next, starting the second circulation, as shown in FIG. 5, the image I5 of the fifth subject copy D5 is copied on the third copying sheet P3 and the resulting third copying sheet P3 is ejected to the paper tray 19 (see FIG. 6).

Then, the feeding of the copying sheets is switched from the paper cassette 17 to the middle tray 20. The first copying sheet P1 is reversed and fed to the photoconductive drum 16 through the effect of the feed-out belt 22. The first copying sheet P1 has the image I4 copied on one side. In the meantime, the fourth subject copy D4 is skipped without being scanned on the rotary drum 15, because the fourth subject copy D4 has been copied. Hence, the third subject copy D3 is guided to the rotary drum 15.

The feeding belt 18 and the feed-out belt 22 are an air absorption type. The time required for switching the air feeding system plus the time required for feeding the copying sheet P1 from the middle tray 20 to the photosensitive drum 16 after being switched is longer than the time required for guiding the third subject copy D3 to the rotary drum 15 after copying the fifth subject copy D5. Hence, as shown in FIG. 6, the subject copy D3 is waiting before the rotary drum 15 while the copying sheet P1 is fed to the photosensitive drum 16.

When the copying sheet P1 is fed from the middle tray 20 to the photosensitive drum 16, as shown in FIG. 7, the image I3 of the subject copy D3 is copied on the non-use side of the copying sheet P1. Then, the resulting copying sheet P1 is ejected to the paper tray 19.

Next, the second copying sheet P2 is fed from the middle tray 20 to the photosensitive drum 16. In the meantime, the second subject copy D2 is skipped without being copied and the first subject copy D1 is guided to the rotary drum 15. And, the image I1 of the subject copy D1 is copied on the non-use side of the copying sheet P2 (see FIG. 8) and the resulting copying sheet P2 is ejected to the paper tray 19. At a time, all the subject copies D5 to D1 are fed back to the subject-copy platform 12 and the double side copying has been done (see FIG. 9).

It will be appreciated from the above description that the double-side copying process consists of copying of the fourth subject copy D4, copying of the second subject copy D2, copying of the fifth subject copy D5, switching of the paper-feeding sources, copying of the third subject copy D3, and copying of the subject first copy D1. While the subject copies D5 to D1 are circulated twice, the overall copying process is completed.

In copying an image formed on each one side of the subject copies by using both sides of the copying sheet, however, the foregoing process requires temporary interrupt of circulating the subject copies when switching the paper-feeding source if the number of the subject copies is odd. It results in disadvantageously making the copying time longer. For example, if the number of the subject copies is 5, as stated above, when the fifth subject copy D5 is copied (see FIG. 5), the paper-feeding source is switched from the paper cassette 17 to the middle tray 20. The switching process needs a considerably long time in switching an air feeding system and feeding the copying sheets from the middle tray 20 to the photosensitive drum 16 after being switched.

Hence, the third subject copy D3 has to wait before the rotary drum 15 until the copying sheet is started to be fed from the middle tray 20.

As depicted in FIGS. 1 to 9, a push-up roller 23 is adapted to push out each of the subject copies from the subject copy platform 12 in sequence.

SUMMARY OF THE INVENTION

It is therefore an object of the present invention to provide a copying machine which is capable of smoothly feeding the copying sheets without letting the subject copy wait when the subject copy is copied by using both sides of the copying sheets.

The object of the present invention can be achieved by a copying machine which is capable of continuously copying two or more one-side subject copies on both sides of copying sheets, the copying machine having a light scanning unit for scanning the subject copies includes a unit for passing two or more subject copies through a light scanning location of the light scanning unit, a unit disposed in the passing unit for feeding the copying sheets to the light scanning unit, a unit coupled to the passing unit for reversing the copying sheets having images formed by the light scanning unit on one sides thereof, a unit coupled to the passing unit for refeeding the reversed copying sheets to the light scanning unit, a unit connected to the passing unit for detecting a number of the subject copies passing through the passing unit, and a unit connected to the passing unit for controlling the passing unit so that the subject copies pass through the light scanning location of the light scanning unit sequentially in circulation from a final page to a first page, the control unit including a unit for copying the final subject copy, a subject copy which is one previous to the final subject copy, and every other subject copy following the subject copy which is one previous to the final subject copy on the copying sheets sequentially fed from the feeding unit at a first circulation in a case that the numbers of the subject copies detected by the detecting unit are odd.

In operation, in a case that the number of the subject copies is odd, the final subject copy is copied at the head of the first circulation of the subject copies. During the second circulation of the subject copies, the subject copy two-previous to the final subject copy and the every other subject copy following the subject copy two-previous to the final subject copy are copied. That is, during the first circulation of the subject copies, the final subject copy and the even subject copies are copied. During the second circulation, the odd subject copies except the final subject copy are copied.

The switching operation of the paper-feeding source from the normal paper-feeding unit to the refeeding unit is started after the copying of the second subject copy, which is the final copying at the first circulation. Then, from the subject copy two-previous to the final page, that is, the first subject copy to be copied at the second circulation, the used copying sheets fed from the refeeding unit are used so that those subject copies are copied on each non-used side of the copying sheets.

While the paper-feeding source is switched, the first page, the final page, and the page one-previous to the final page are skipped without being copied. The foregoing copying process known by the present inventors, on the other hand, only one subject copy is skipped (In the known process, after copying the final subject copy, that is, the first copying at the second circulation, the paper-feeding source is switched. From the subject copy two-previous to the final subject copy at the second circulation, the copying sheets fed from the refeeding unit are used for copying. Hence, the subject copy to be skipped while the paper-feeding source is switched is one subject copy one-previous to the final subject copy). Hence, as described above, the three subject copies to be skipped while the paper-feeding source is switched are continuously skipped. In this case, the copying-interrupt time is made far longer. Since the switching of the paper-feeding sources and the paper-feeding from the refeeding unit after switching are finished during the copying-interrupt period, like the known process, while the paper-feeding source is switched, it is possible to eliminate the necessity of temporarily interrupting the circulation of the subject copies for letting the subject copy waiting before the light scanning point. It results in reducing the overall copying time. In other words, in copying two or more subject copies having images on one side by using both sides of the copying sheets, the necessary circulating time of the subject copies is two in the known copying machine and the present copying machine. It means that the necessary time for the circulations is equal in both of the machines. However, the known copying machine needs to interrupt the circulation of the subject copies while the paper-feeding source is switched, while the present copying machine has no waiting time, resulting in reducing the necessary time for copying accordingly.

Further, in copying two or more subject copies having images on one side by using both sides of the copying sheets, the known copying machine skips the subject copies regularly, that is, on every other one, while the present copying machine serves to continuously copy two subject copies at the head of the circulation of the subject copies at the first circulation. With the two subject copies being continuously copied, during the switching interval for the paper-feeding source, the three subject copies are skipped so that the longest copying interrupt period is overlapped with the switching period of the paper-feeding source.

In a case that the number of the subject copies is even, like the known copying machine, during the first circulation of the subject copies, the even number of subject copies are sequentially copied on one side of each copying sheet. During the second circulation of the subject copies, the odd number of subject copies are sequentially copied on the other side of each coping sheet.

As described above, the copying machine according to the present invention is arranged to skip three subject copies, that is, the first page, the final page, and the page one-previous to the final page without being copied. This skipped pages are far larger than the skipped page, one, of the known copying machine. Hence, while the continuous three subject copies are being skipped, it provides a sufficiently long time for completing the switching of the paper feeding source and the paper feeding from the refeeding unit after switching the paper-feeding source. As such, it is possible to eliminate the necessity of letting the subject copy wait before the light scanning point while the paper-feeding source is switched. It results in reducing the overall copying time if the number of the subject copies is odd.

More preferably, the control unit further includes a unit for ejecting a copying sheet having the final page copied thereon at a first circulation in a case that the numbers of the subject copies detected by the detecting unit are odd.

Further preferably, the control unit further includes a unit for storing each copying sheet having the other subject copies copied on one side in the refeeding unit at a first circulation in a case that the numbers of the subject copies detected by the detecting unit are odd.

The control unit further includes a unit for copying uncopied subject copies on non-use side of each copying sheets fed from the refeeding unit at a second circulation in a case that the numbers of the subject copies detected by the detecting unit are odd, preferably.

The control unit includes a unit for copying the final subject copy and every other subject copies following the final subject copy on the copying sheets fed from the feeding unit at a first circulation in a case that the numbers of the subject copies detected by the detecting unit are even, preferably.

The control unit further includes a unit for storing the resulting copying sheets in the refeeding unit at a first circulation in a case that the numbers of the subject copies detected by the detecting unit are even, preferably.

The control unit further includes a unit for copying the uncopied subject copies on the non-use side of each copying sheet fed from the refeeding unit at a second circulation in a case that the numbers of the subject copies detected by the detecting unit are even, preferably.

Preferably, the control unit includes a microcomputer for controlling the passing unit in an interlocking manner.

More preferably, the microcomputer is a central processing unit.

Further preferably, the control unit further includes a plurality of sensors for detecting the numbers of the subject copies.

The passing unit is a rotary drum housing, preferably.

The feeding unit is composed of one or more paper cassettes, preferably.

The refeeding unit is a middle tray, preferably.

The control unit is preferably adapted to control a passage of the subject copies so that all of the subject copies are copied on both sides of each copying sheet at one circulation in a case that the numbers of the subject copies are three.

Preferably, the copying unit for copying the final subject copy, a subject copy which is one previous to the final subject copy, and every other subject copy following the subject copy which is one previous to the final subject copy on the copying sheets sequentially is a rotary drum.

Further objects and advantages of the present invention will be apparent from the following description of the preferred embodiment of the invention as illustrated in the accompanying drawings.

DESCRIPTION OF THE PREFERRED EMBODIMENT

Figure 2:
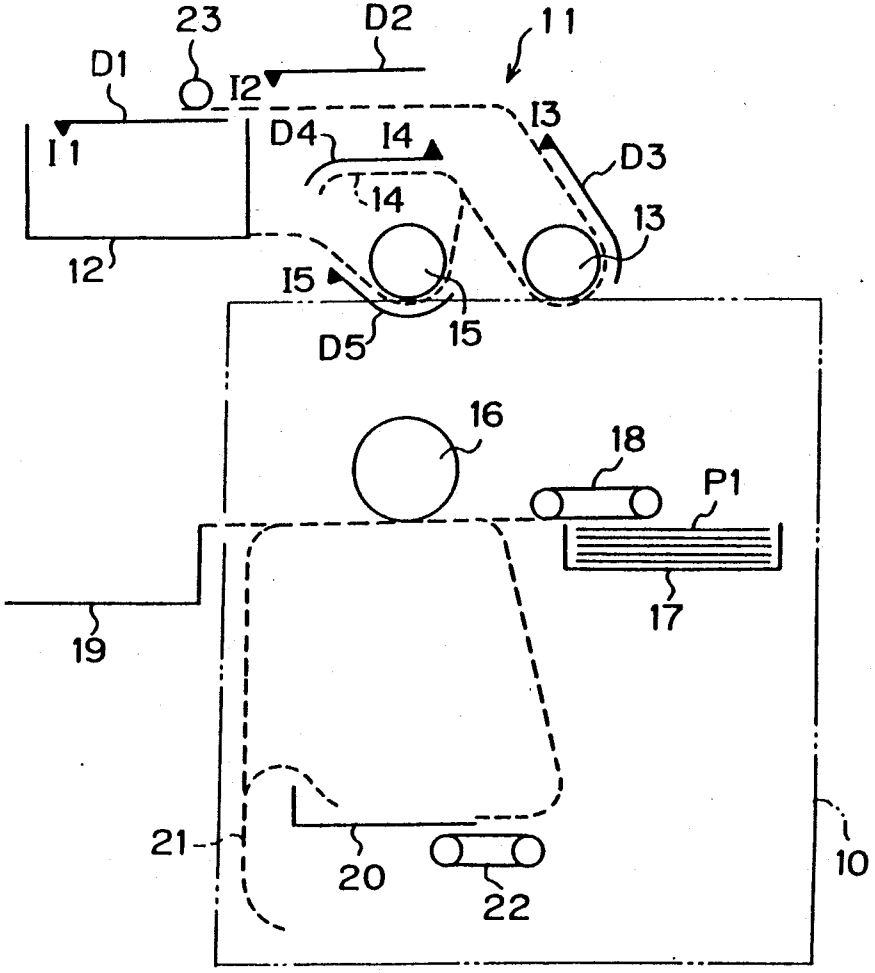
Fig. 2 PRIOR ART
FIGS. 1 to 9 are explanatory views showing the process of copying one-side subject copy by using the double sides of the copying sheets if the number of the subject copies is 5 according to the copying machine known by the present inventors.
Figure 1:
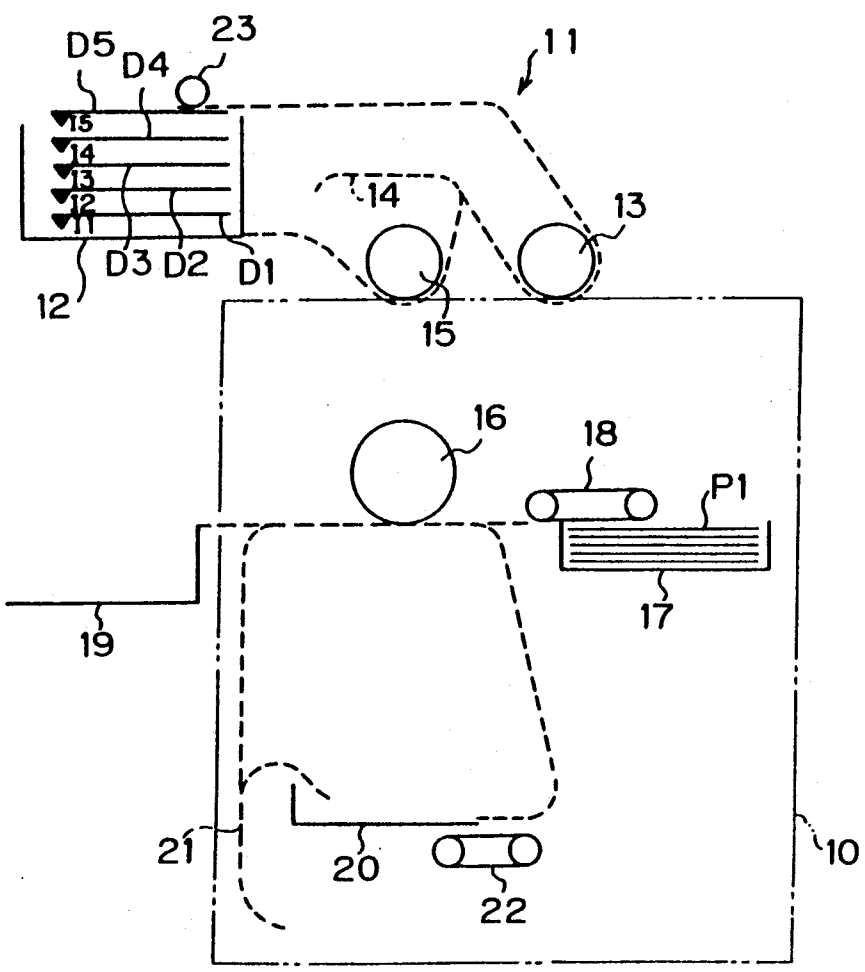
Fig. 1 PRIOR ART
Figure 4:
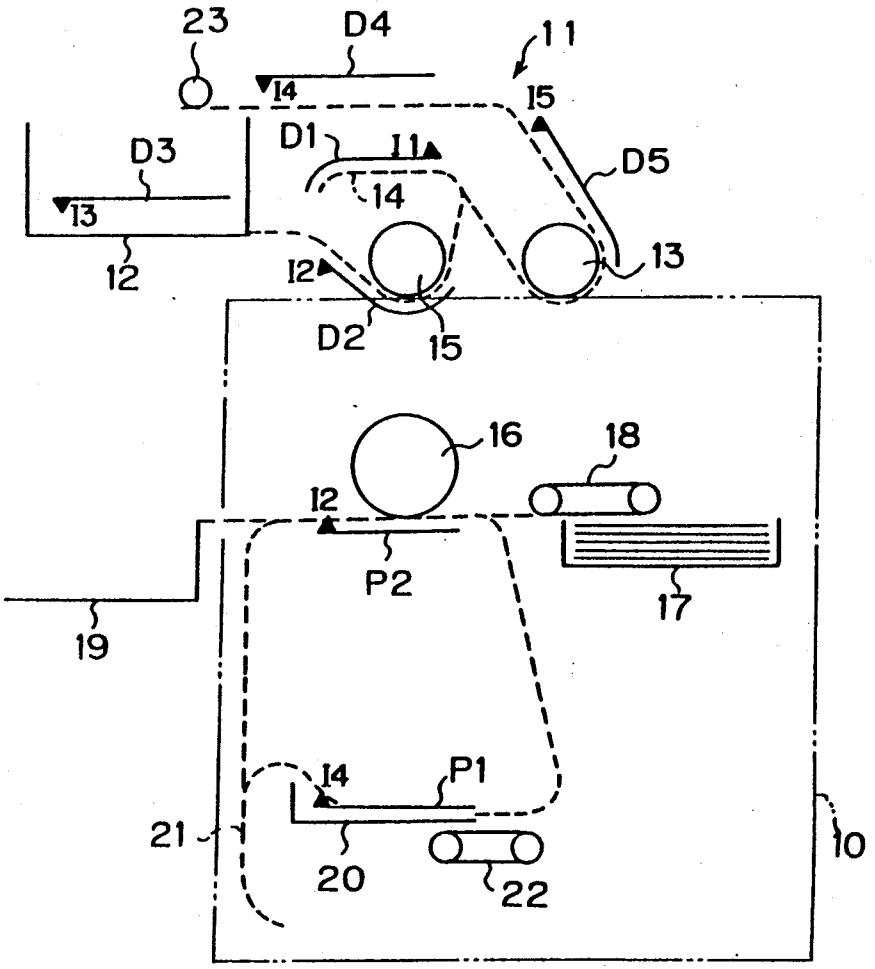
Fig. 4 PRIOR ART

Referring to FIGS. 10 to 27, an embodiment of a copying machine according to the present invention will be described in the following parts.

The copying machine according to the present embodiment includes a main body 31, a RDH (Rotary Drum Housing) 32 located on the top of the main body 31, and a subject-copy platform 33 adjacent to the RDH 32. The subject-copy platform 33 is made of transparent glass and is covered by a subject-copy cover 34.

The subject-copy cover 34 is allowed to be closed or opened. This subject-copy cover 34 serves to press and hold the subject copy (not shown) placed on the subject-copy platform 33. The subject-copy cover 34 therefore makes it possible to copy only one or a few subject copies which do not need the RDH 32 as well as a large or thick subject copy which is not fed by the RDH 32.

Under the RDH 32 and the subject-copy platform 33, there is located an optical system 35 having mirrors 36 to 39, a lens 40 and a light source 41. The optical system 35 serves to exert the light source 41 to apply a light beam to the subject copy for light scanning, to receive the reflected light from the subject copy, and to guide it to a photosensitive drum 42.

In copying the subject copy placed on the subject-copy platform 33, the light source 41 is moved along the platform 33 for light scanning on the subject copy. In copying the subject copies being fed by the RDH 32, the light source 41 applies a light beam to the subject copies through a light scan window 43 or 44 (see FIG. 11).

Under the optical system 35, the photosensitive drum 42 is located in a manner to rotate clockwise. Around the photosensitive drum 42, there are located a charger 45, a developing unit 46, a transfer unit 47, a stripper 48, a cleaning unit 49, and a discharging lamp 50, which compose a copying process mechanism 51.

The copying process mechanism 51 serves to develop an electrostatic latent image formed on the photosensitive drum 42 as a toner image through the effect of the light beam applied from the optical system 35. The toner image is transferred on the copying sheets fed from paper cassettes 52 to 54 or a middle tray 55 (to be described later).

On the paper-ejecting side of the copying process mechanism 51, there are located a feeding belt 56 and a fixer 57. The predetermined copying process is performed on the copying sheet in the copying process mechanism 51. The resulting copying sheet is fed to the fixer 57 through the feeding belt 56. The fixer 57 serves to heat and fix the toner image transferred on the copying sheet.

On the paper-ejecting side of the fixer 57, there is provided a feeding-unit switcher 58. The feeding-unit switcher 58 includes a gate flapper 59 for switching the traveling path of the copying sheets to an offset tray 60 or the middle tray 55. The offset tray 60 includes a paper tray 61. In a case of using one side of each copying sheet for copying, the copying sheets are ejected to a paper tray 61 through a reversing roller 62. The height of the paper tray 61 is adjustable depending on the number of the copying sheets ejected thereon.

In a case of using double sides of each copying sheet for copying, the copying sheet is fed to the reversing mechanism 63 having the gate flapper 64 and a reversing roller 65. The reversing roller 65 serves to reverse the feeding direction of the copying sheets. Then, the copying sheets are ejected to the middle tray 55.

In a case of synthesizing copy, that is, copying two or more images on one side of each copying sheet, the copying sheet passed through the fixer 57 is guided to the reversing roller 62. The feeding direction of the copying sheet is reversed so that the copying sheet is fed to the reversing mechanism 63. The reversing mechanism 63 serves to reverse the feeding direction of the copying sheet again. Then, the copying sheet is ejected to the middle tray 55.

The middle tray 55 serves as refeeding unit. It is located under the feeding belt 56 and the fixer 57. The copying sheets in the middle tray 55 are sequentially sent out to the photosensitive drum 42 from the lowermost sheet on a predetermined timing. For sending out those sheets, an air-absorption type feed-out belt 66 is provided on the paper-ejecting side.

Under the middle tray 55, the paper cassette 53 is located and under the developing unit 46 the paper cassettes 52, 54 are located. The new copying sheets are located in the paper cassettes 52 to 54. Those new sheets are sequentially fed from the cassettes 52 to 54 from the uppermost sheet through the effect of the feeding belts 67 to 69.

The middle tray 55, the paper cassettes 52 to 54 and the photosensitive drum 42 surround a feeding path 70 branched to each paper cassette 52 to 54 and a feeder 71 having two or more feeding rollers 71*b*. A side of the photosensitive drum 42 of the feeder 71 is provided a resist roller 72 for temporarily stopping the copying sheet being fed if necessary and feeding the copying sheet to the photosensitive drum 42 on a predetermined timing.

Figure 11:
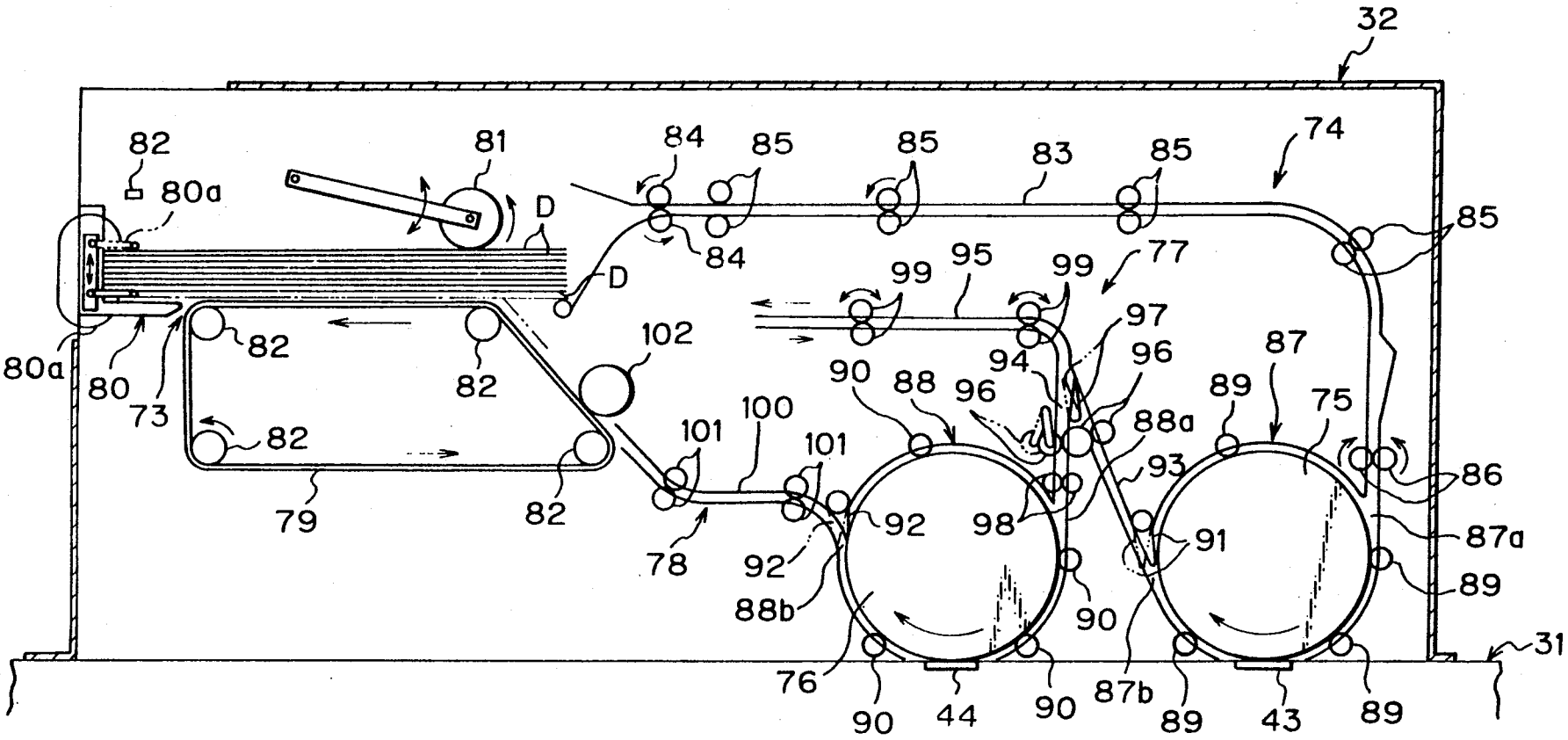
FIG. 11 is a schematic block diagram showing a rotary drum housing included in the embodiment of the present invention.

Then, the RDH 32 will be described in detail with reference to FIG. 11

As shown, the RDH 32 includes the subject-copy platform 73, the feeding mechanism 74, rotary drums 75, 76, a reversing mechanism 77, and a returning mechanism 78.

The subject-copy platform 73 is composed of the upper side of the feeding belt 79 served as a horizontal feeding surface and a subject-copy hopper 80. Two or more subject copies are placed on the upper horizontal side of the feeding belt 79 so that the edges of the subject copies are received in the subject-copy hopper 80. At the paper outgoing side of the platform 73 there is provided a feeding roller 81 for picking up the subject copies D on a predetermined timing.

The feeding belt 79 is driven by four driving rollers 82 so that the subject copy D returned from the light scanning (to be described later) is inserted into the lower side of the subject-copy hopper 80. For facilitating the insertion of the subject copy, a push-up roller 81 is provided for pushing up the rear end of the subject copy.

The subject-copy hopper 80 includes a sensing actuator 80*a* for sensing one circulation of the placed subject copies D. The sensing actuator 80*a* is located at the lowermost side as shown by a real line before setting the subject copies D. The subject copies D are placed on the sensing actuator 80*a* located at the lowermost site. As the subject copies D are fed one by one and is returned by the returning mechanism 78, the sensing actuator 80*a* rises accordingly. When all the subject copies D are circulated, the sensing actuator 80*a* reaches the uppermost site as shown by an imaginary line. The uppermost sensing actuator 80*a* is sensed by a one-circulation sensor 82.

The one-circulation sensor 82 is located above the subject-copy hopper 80 so that it serves to sense that all the subject copies are circulated. When the one-circulation sensor 82 is sensed, the one-circulation sensor 82 serves to send out a sensing signal indicating the termination of one circulation. By using the sensing signal, it is possible to control the number of copies. The sensing actuator 80*a* is rotated 180° around the subject-copy hopper 80 and is returned to the lowermost side as shown by a real line after one circulation of the copying sheets D is terminated.

The feeding mechanism 74 provides a feeding path 83, a pair of separating rollers 84, a pair of feeding rollers 85 located at a predetermined interval, and a pair of resist rollers 86.

The feeding path 83 is located from the paper-outgoing side of the subject-copy platform 73 to a paper inlet 87*a* of the outer peripheral path 87. The separating rollers 84 are located slightly inward of the paper inlet of the feeding path 83, while the resist rollers 86 are provided near the paper inlet 87*a*.

The pair of separating rollers 84 are located vertically. Those rollers 84 are rotated in the same direction so that when two or more subject copies D are taken at a time, the rollers 84 serve to separate those piled subject copies. The pair of resist rollers 86 serve to temporarily stop the subject copies D fed by the feeding rollers 85 if necessary so that those subject copies D are allowed to be fed to the rotary drum 75 on a predetermined timing.

The rotary drums 75, 76 are driven to rotate clockwise. The outer peripheral paths 87, 88 rotationally provide a plurality of driven rollers 89 and 90 at intervals so that those driven rollers 89, 90 come into contact of the outer peripheral surfaces of the rotary drums 75, 76, respectively. The driven rollers 89 and 90 serve to push the subject copies D onto the rotary drums 75 and 76 for assisting the feeding of the subject copies D.

On the upper end of the copying machine main body 31, the light scanning windows 43 and 44 made of glass are provided in a manner to be opposed to the lower end of the rotary drums 75 and 76. The light source 41 (see FIG. 10) serves to apply a light beam onto the subject copies D through the light scanning windows 43 and 44 for the purpose of light scanning.

At the paper outlets 87*b* and 88*b* of the outer peripheral feeding paths 87 and 88, the gate flappers 91 and 92 are provided for switching the traveling path of the subject copies D. When light scanning is performed on the same subject copy twice or more times for the purpose of copying the same subject copy on two or more copying sheets, the paper outlets 87*b* and 88*b* of the outer peripheral feeding paths 87 and 88 are closed so as to form circular outer peripheral feeding paths 87 and 88 around the rotary drums 75 and 76. It results in circulating the same subject copy D around the rotary drums 75 and 76 desired times.

In a case that the predetermined times of light scanning are terminated or the light scanning is not performed, the gate flapper 91 is rotated to the location shown by a real line so that the upper half of the outer peripheral feeding path 87 is closed. It resulting in forming the path for guiding the subject copies D to the reversing mechanism 77. On the other hand, the gate flapper 92 is rotated to the location shown by a real line so that the upper half of the outer peripheral feeding path 88 is closed. It results in forming the path for guiding the subject copies D to the returning mechanism 78.

The reversing mechanism 77 includes feeding paths 93, 94, a reverse-feeding path 95, feed-out rollers 96, a gate flapper 97, a pair of resist rollers 98, and a pair of reversing rollers 99. Each ends of the feeding paths 93, 94 are respectively connected to the paper output 87*b* of the outer peripheral feeding path 87 and the paper inlet 88*a* of the outer peripheral feeding path 88. The other ends of the feeding paths 93, 94 are gathered and connected to the reverse-feeding path 95.

The feed-out rollers 96 are provided near the gathered portion of the feeding paths 93, 94. Those feed-out rollers 96 serve to send out the subject copies D to the reverse-feeding path 95 or to the rotary drum 76. The gate flapper 97 serves to switch the traveling path of the subject copies D. The pair of resist rollers 98 are provided near the paper inlet 88*a* of the feeding path 94 so that those resist rollers 98 serve to temporarily stop the subject copies D if necessary and then feed them to the rotary drum on a predetermined timing.

The pair of reversing rollers 99 are provided on the reverse-feeding path 95 so that those reversing rollers 99 serve to reverse the traveling direction of the subject copies D.

The returning mechanism 78 includes a feeding path 100 and a plurality of feeding roller 101. The feeding path 100 is located from the paper outlet 88*b* of the outer peripheral feeding path 88 to the feeding belt 79. The feeding belt 79 composes part of the subject-copy platform 73 and also serves as the returning mechanism 78. That is, the feeding belt 79 feeds to the subject-copy platform 73 the subject copies D returned through the feeding path 100. The feeding belt 79 provides a pressing roller 102 so that the roller 102 serves to press the subject copies D on the feeding belt 79 for the purpose of assisting the feeding of the belt 79.

Figure 12:
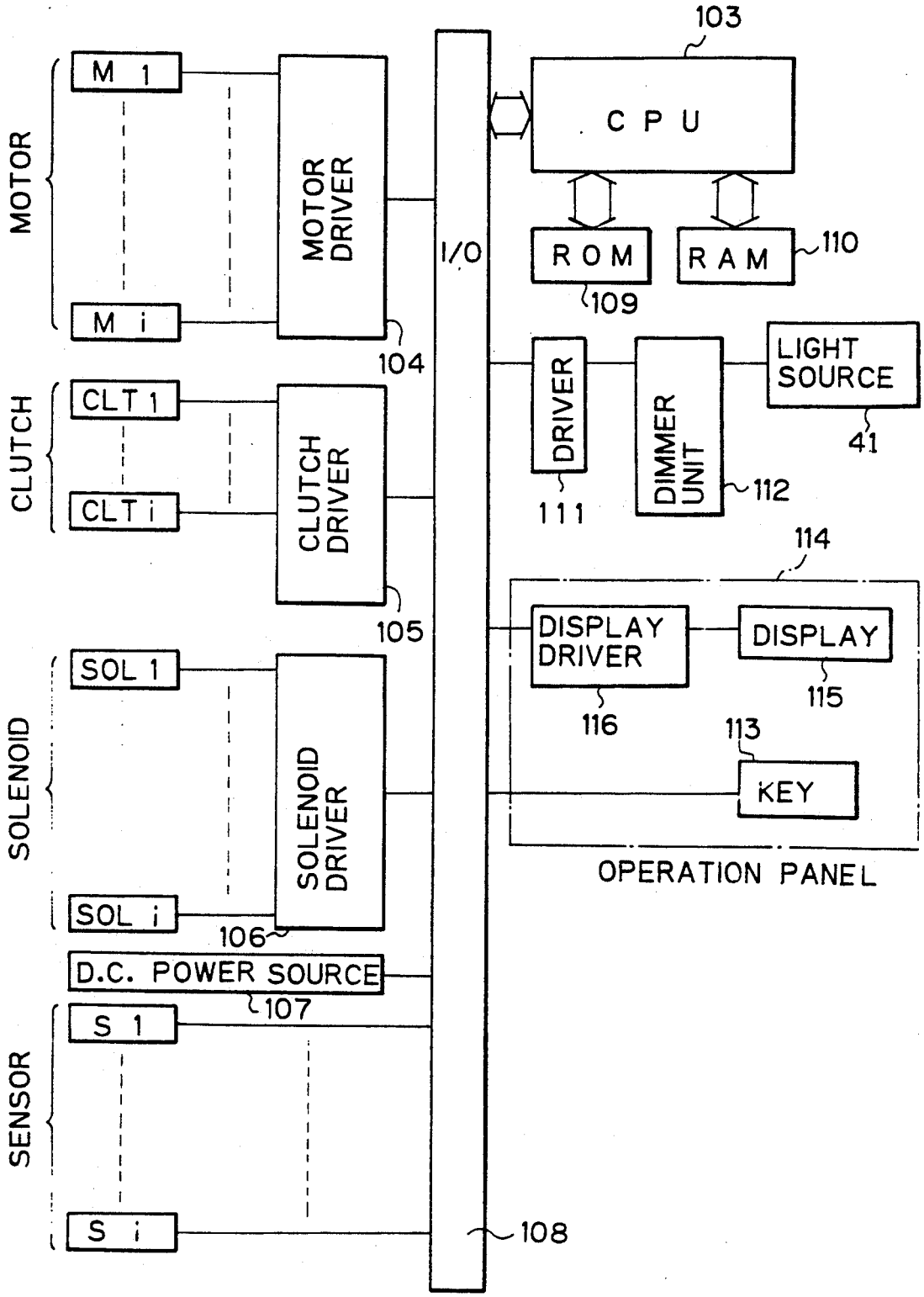
FIG. 12 is a block diagram showing a control unit included in the embodiment of the present invention.

In turn, the description will be directed to a control unit with reference to FIG. 12.

As shown in FIG. 12, the control unit includes a microcomputer 103 for controlling the copying machine main body 31 and the RDH 32 in an interlocking manner.

Figure 3:
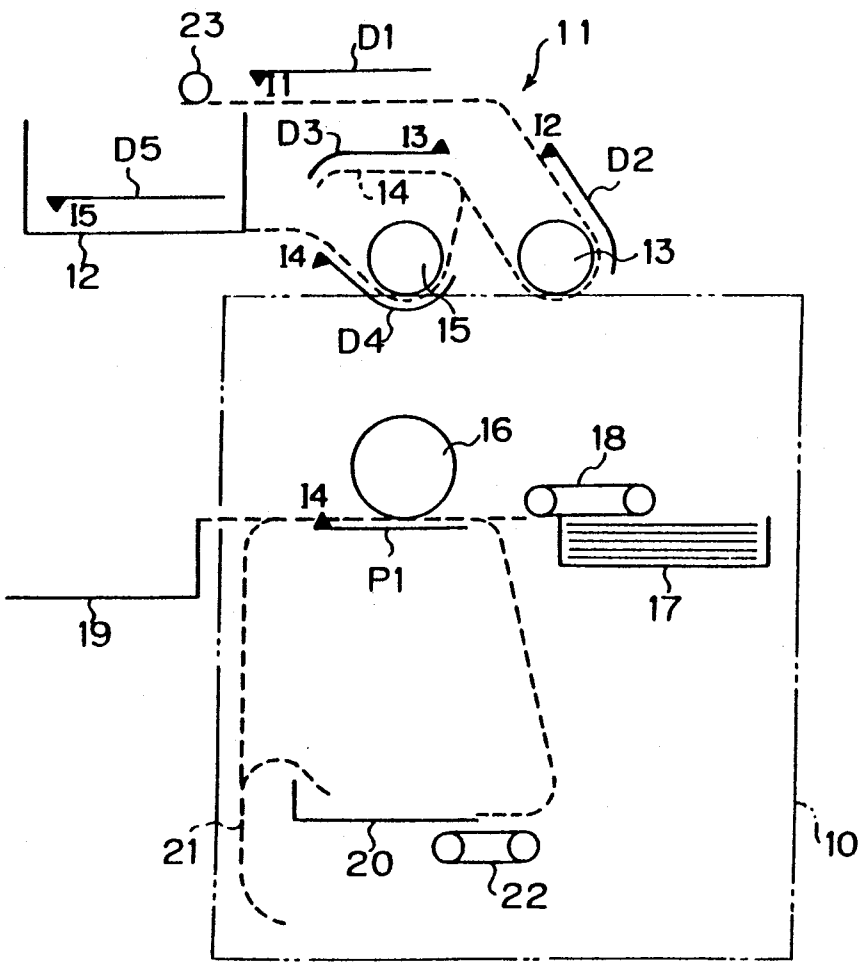
Fig. 3 PRIOR ART

A plurality of motors M1 to Mi are provided for driving the rotary components such as the photosensitive drum 42 and several feeding rollers included in the copying machine main body 31 and the RDH 32. Those motors M1 to Mi are connected to a motor driver 104. A plurality of clutches CLT1 to CLTi are provided for intermittently driving the resist rollers 72, 86 (see FIGS. 2 and 3). Those clutches CLT1 to CLTi are connected to a clutch driver 105. A plurality of solenoids SOL1 to SOLi are also provided for driving the gate flappers 59,64. Those solenoids SOL1 to SOLi are connected to a solenoid driver 106. A plurality of sensors S1 to Si are provided for sensing the passage of the subject copies D and the copying sheets at a predetermined location.

The control elements such as those drivers 104 to 106, a d.c. power source 107, and those sensors S1 to Si are all connected to an interface circuit 108 for the purpose of controlling the feeding of the subject copies and the copying sheets and the copying process mechanism.

The interface circuit 108 is connected to the microcomputer 103 so that the interface circuit 108 sends out the sensing signals of the sensors S1 to Si to the microcomputer 103 and controls the drivers 104 to 106 in accordance with the control signals sent from the microcomputer 103.

The microcomputer 103 is connected to a ROM 109 and a RAM 110. The ROM 109 stores a control program on which the microcomputer 103 serves to control the control components. The control includes the copying process of copying an image formed on one side of the subject copy by using both sides of the copying sheet. On the other hand, the RAM 110 is used for a buffer memory or an operating area for a flag, a counter, a timer and the like required for controlling the copying operation.

The interface circuit 108 is connected to the light source 41 through a driver 111 and a dimmer unit 112. The interface circuit 108 is also connected to an operation key 113 included in an operation panel 114 (to be described later) as well as to a display unit 115 through a display driver 116.

Figure 13:
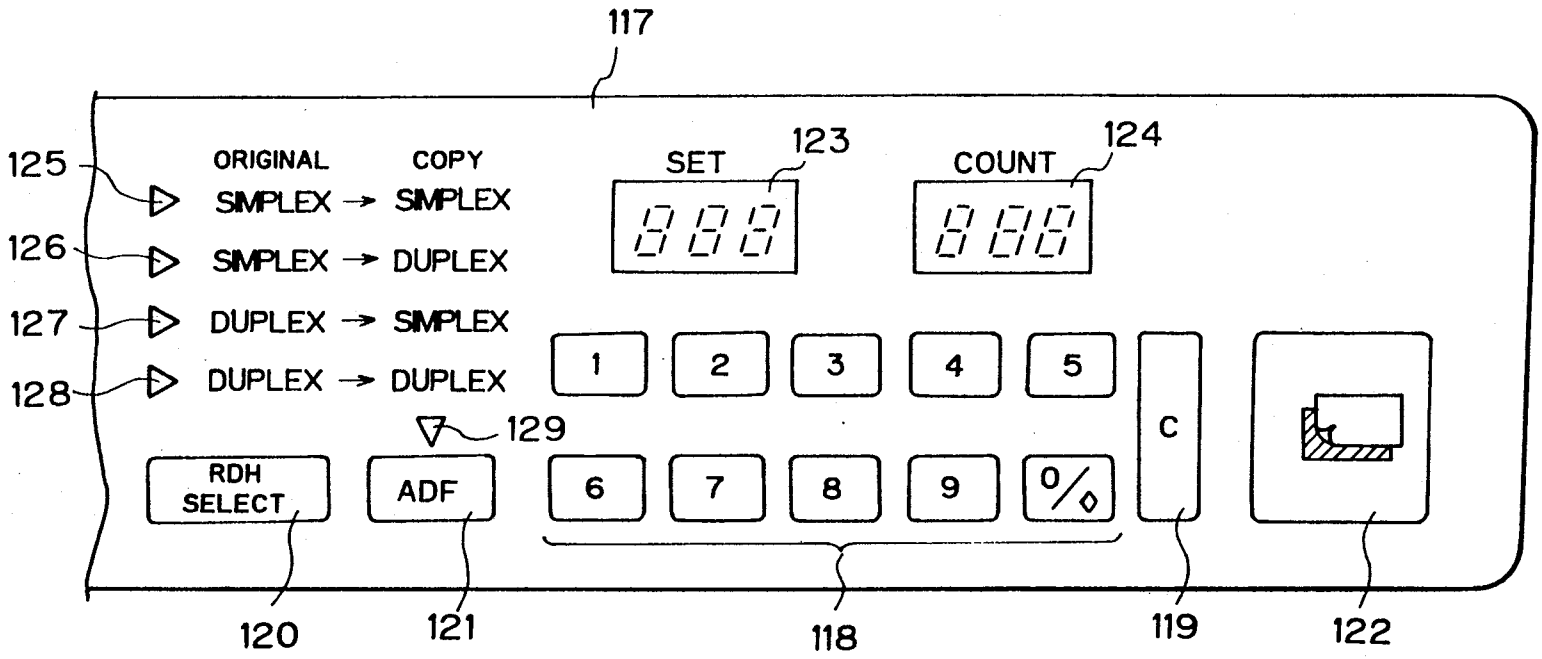
FIG. 13 is an elevation view showing an operation panel included in the embodiment of the present invention.

As shown in FIG. 13, the operation panel 117 includes template keys 118, a clear key 119, a RDH selection key 120, an ADF key 121, a print switch 122, a set display 123, a count display 124, mode displays 125 to 128, and an ADF display section 129.

The template keys 118 are used for setting the copy number. The clear key 121 is used for clearing the set copy number. The RDH selecting key 120 is used for selecting a copy mode as a plurality of subject copies are sequentially circulated through the effect of the RDH 32. The ADF key 121 is used for selecting an ADF mode on which one subject copy is continuously copied on a desired number of copying sheets. The print switch 122 is used for indicating start of the copying. The set display 123 is used for displaying the set number of copies. The count display 124 is used for counting the copied sheets and displaying the number of the copied sheets. The mode displays 125 to 128 are used for displaying any one of the four modes of the RDH 32. The ADF display 129 is used for displaying whether or not the ADF mode is selected.

The mode display 125 serves to display a mode at which an image printed on one side of each subject copy is copied by using one side of each copying sheet. The mode display 126 serves to display a mode at which an image printed on one side of each subject copy is copied by using both sides of each copying sheet. The mode display 127 serves to display a mode at which image formed on both sides of each subject copy are copied by using one side of each copying sheet. The mode display 128 serves to display a mode at which images formed on both sides of each subject copy are copied by using both sides of each copying sheet. By one press on the RDH selection key 120, the mode displays 125 to 128 are sequentially switched from the uppermost to the lowermost displays. The mode display 128 at the lowermost location is then returned to the mode display 125 at the uppermost location.

In turn, the description will be directed to the process of the foregoing construction for copying two or more one-side subject copies by using both sides of each copying sheet.

At first, a predetermined number of subject copies D are placed on the subject-copy platform 73 (see FIG. 10) so that the image printed on each subject copy is directed downward and the final page of the subject copies is at the uppermost location. In this state, by pressing the RDH select key 120 (see FIG. 13), the mode is selected for copying a one-side subject copy to both sides of each copying sheet. By pressing the template key 118, the number of copies is selected. By pressing the print switch 122, the copy is started.

In accordance with the indication given by the print switch 122, the microcomputer 103 (see FIG. 12) serves to sense the number of the subject copies D by a proper method. The proper method is, for example, that as the subject copies D are circulated within the RDH 32 with no light scanning on the subject copies D, the number of the subject copies D is counted. Herein, the copying process will be described on the assumption that the number of the subject copies is odd, for example, 5.

Figure 14:
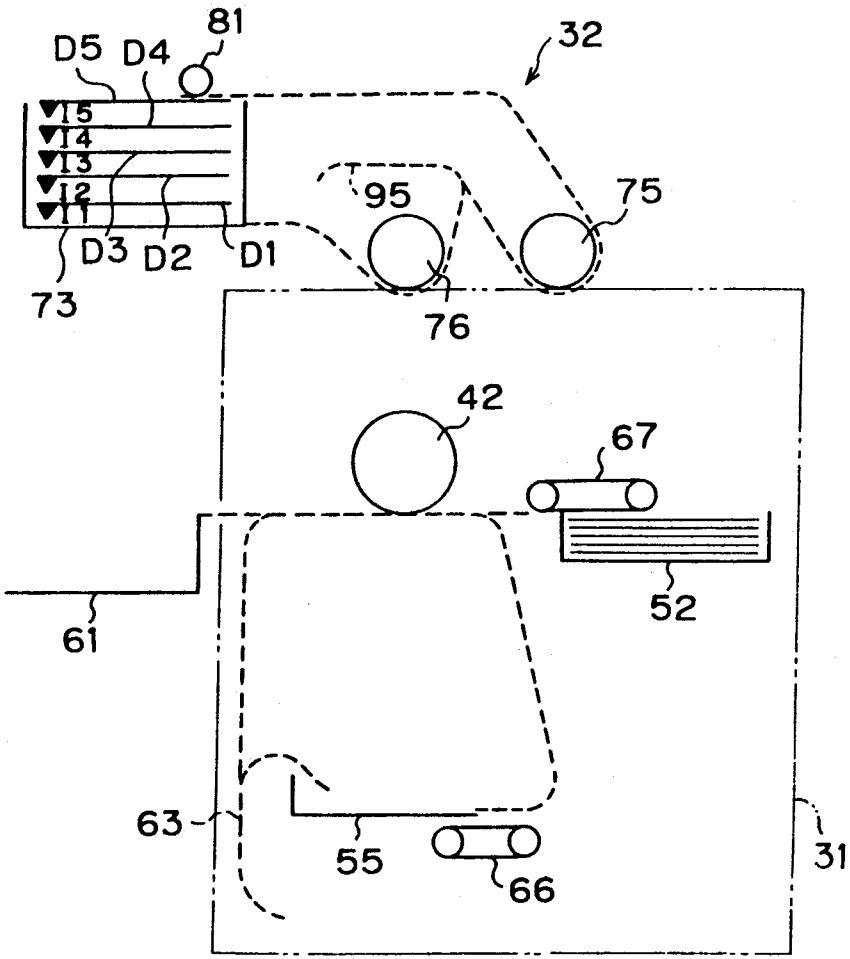

Turning to FIG. 14, the number of the subject copies is 5 (the subject copies are denoted by D1, D2, . . . , D5 in sequence), and the subject copies D1, D2, . . . , D5 have the corresponding image I1, I2, . . . , I5 directed downward.

Figure 15:
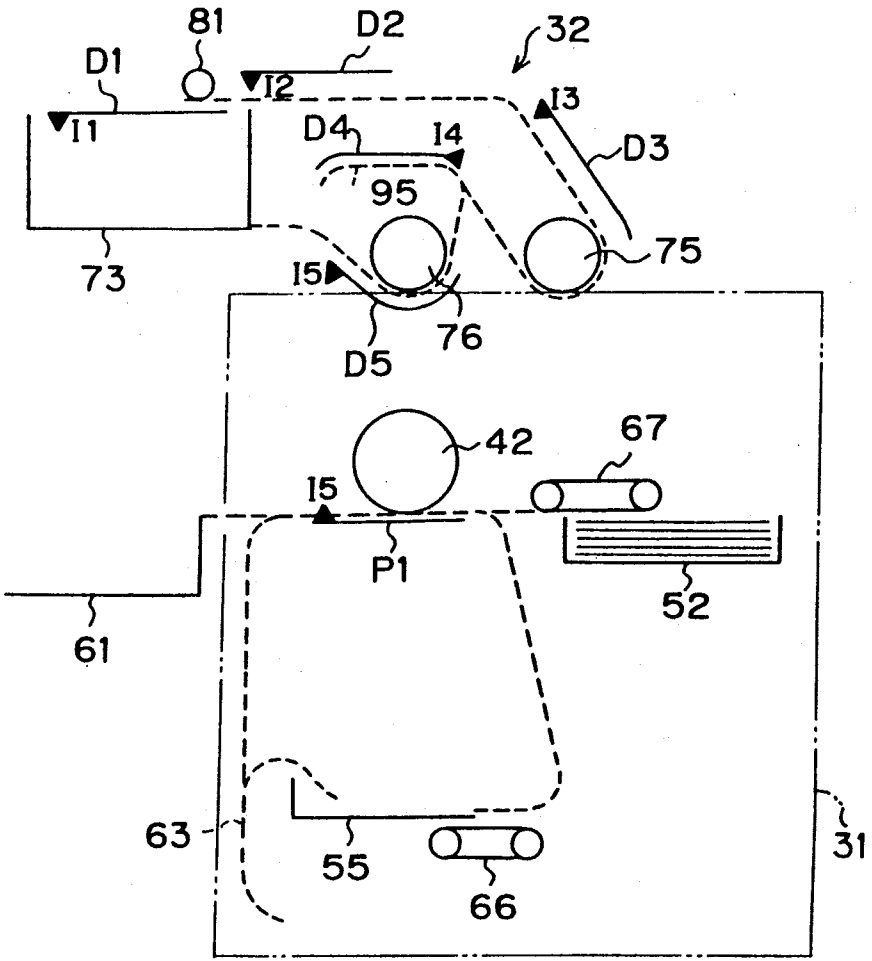
FIGS. 14 to 21 are explanatory views showing the process of copying one-side subject copies by using the double sides of the copying sheets if the number of the subject copies is 5 according to the embodiment of the present invention.

When the copying is started, as shown in FIG. 15, the subject copies are sequentially fed from the final page in a manner of D5, D4, . . . D1. This is the start of the first circulation of the subject copies. When the fifth subject copy D5 is passed through the rotary drum 76, the light beam is applied to the subject copy through the light scanning window 44 (see FIG. 11). The image I5 of the subject copy D5 is copied on the first copying sheet P1 fed from any one of the paper cassettes 52 to 54, for example, the paper cassette 54.

Figure 6:
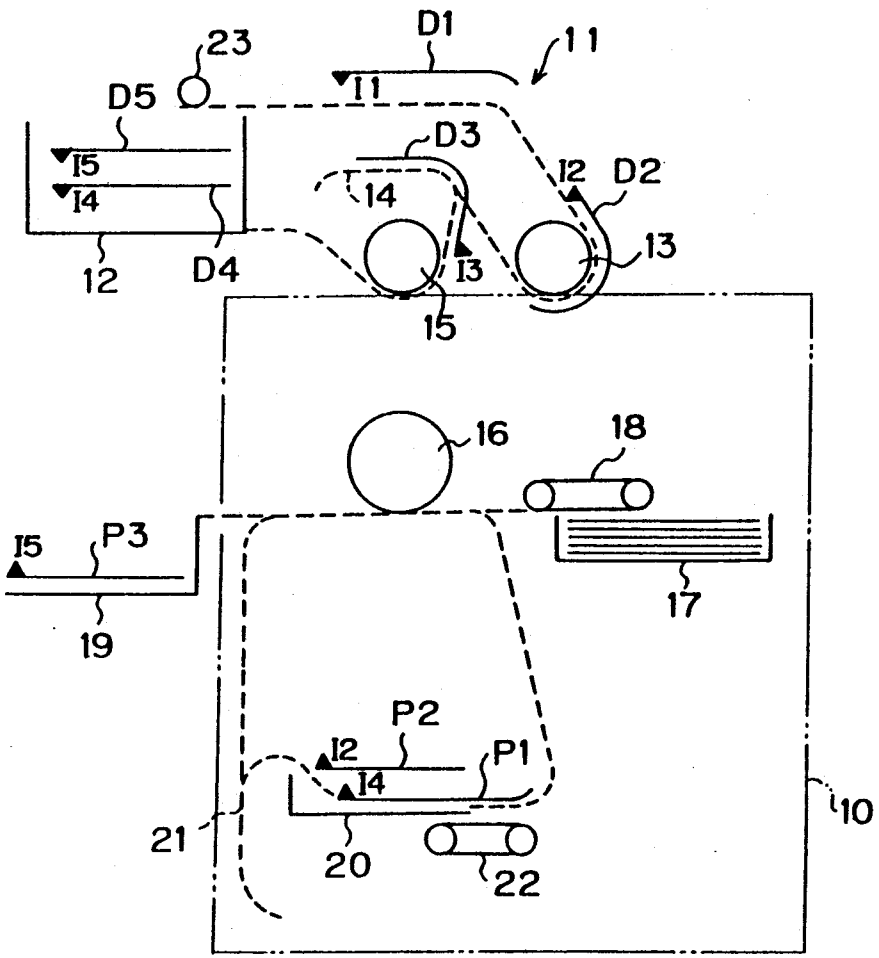
Fig. 6 PRIOR ART
Figure 5:
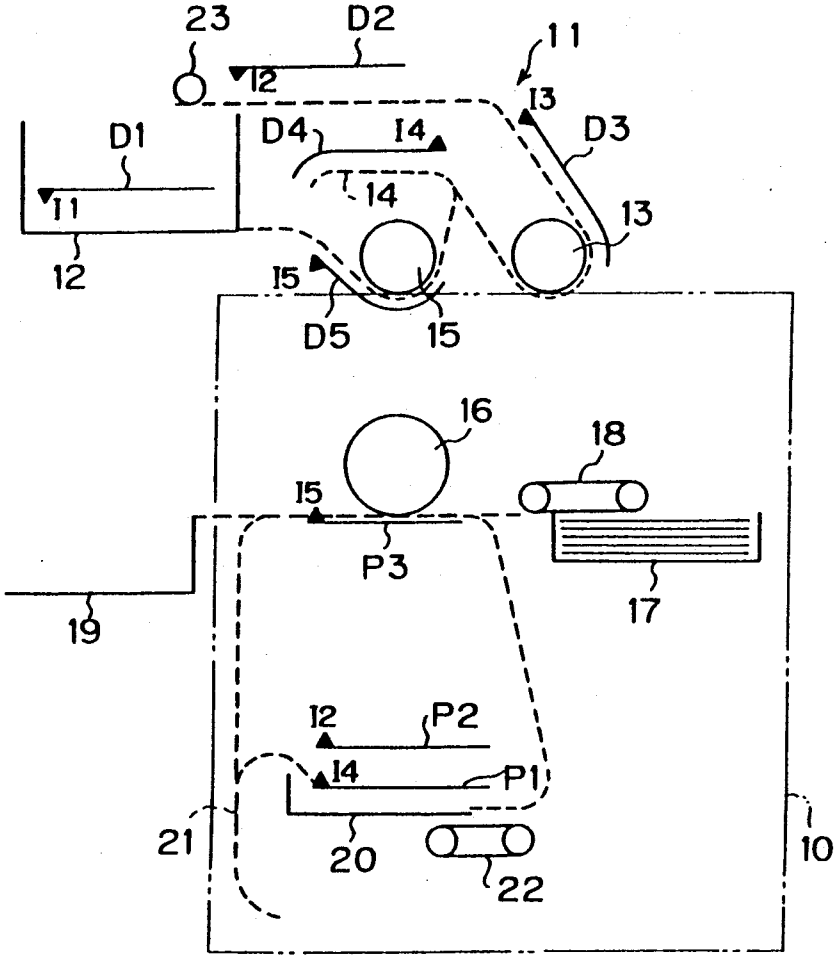
Fig. 5 PRIOR ART
Figure 8:
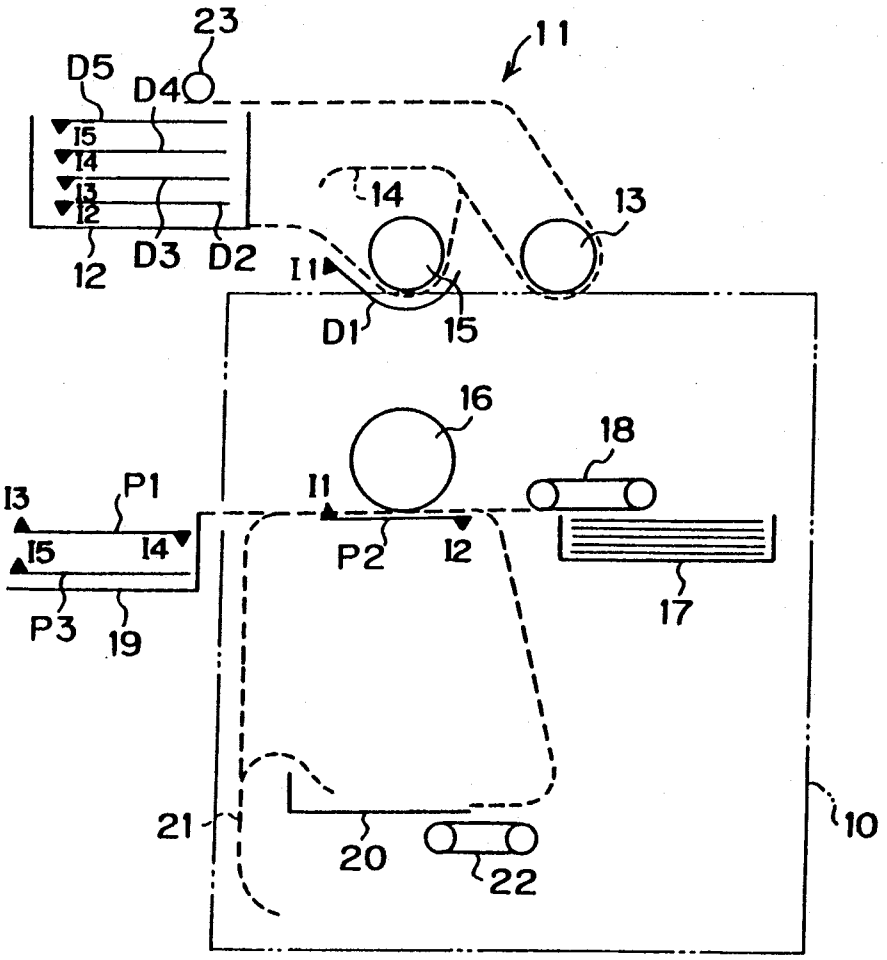
Fig. 8 PRIOR ART
Figure 7:
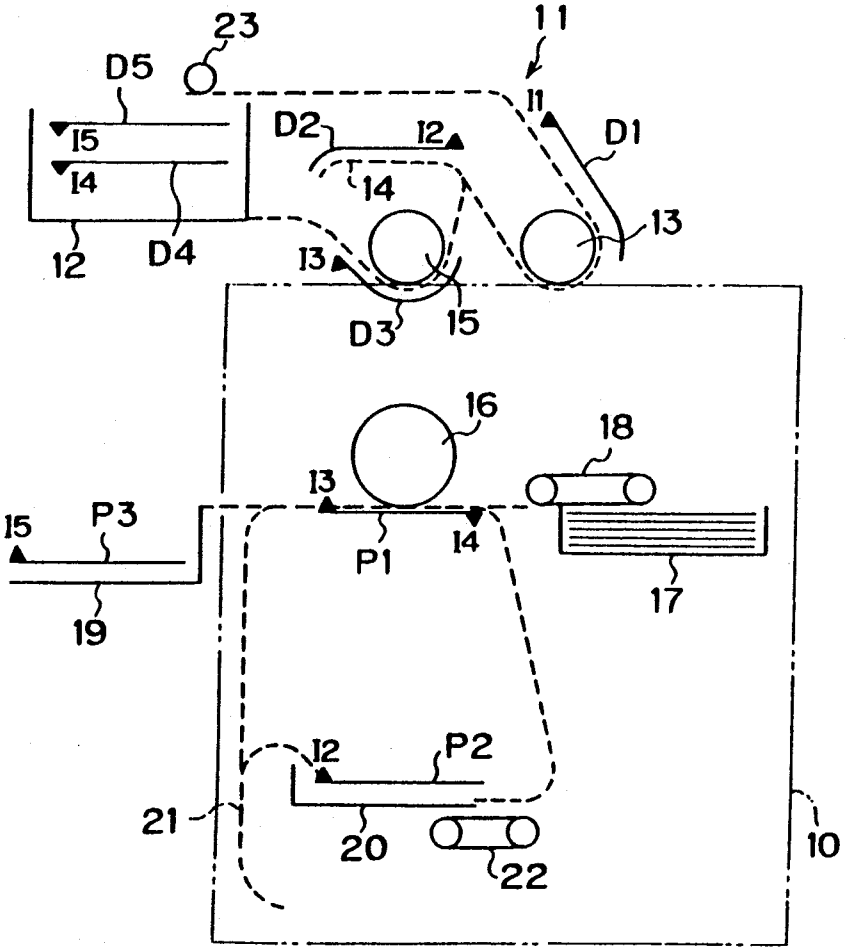
Fig. 7 PRIOR ART
Figure 9:
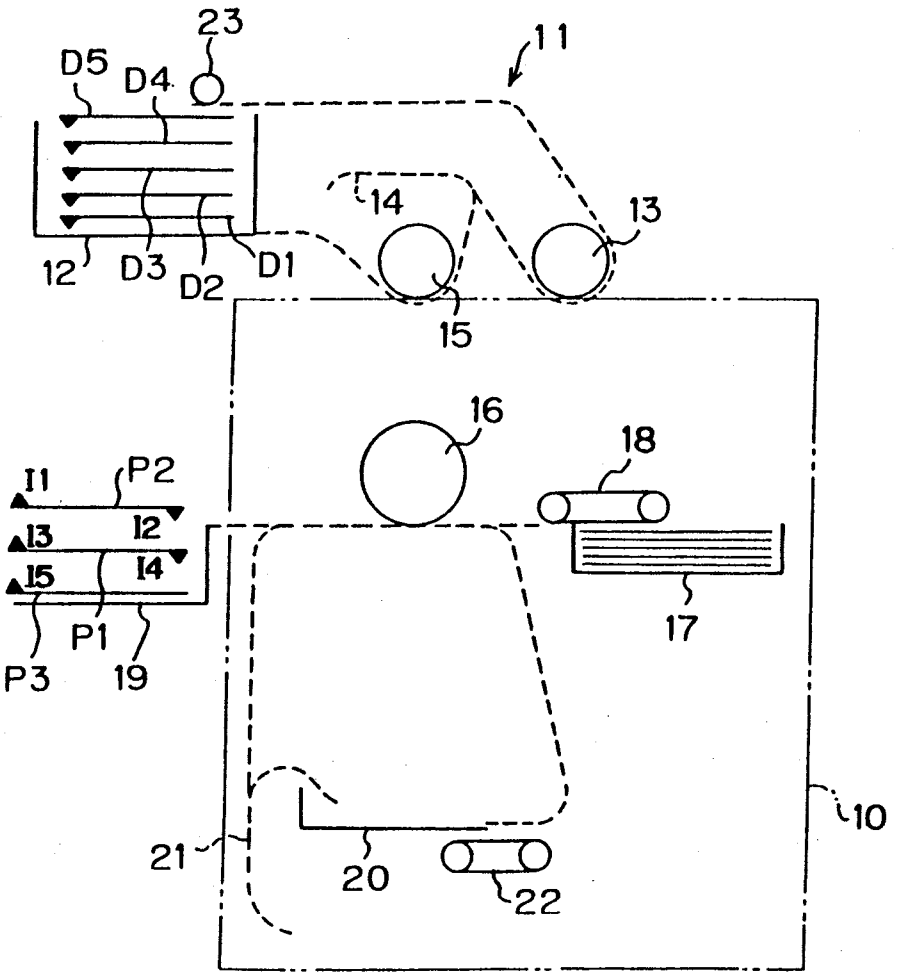
Fig. 9 PRIOR ART
Figure 10:
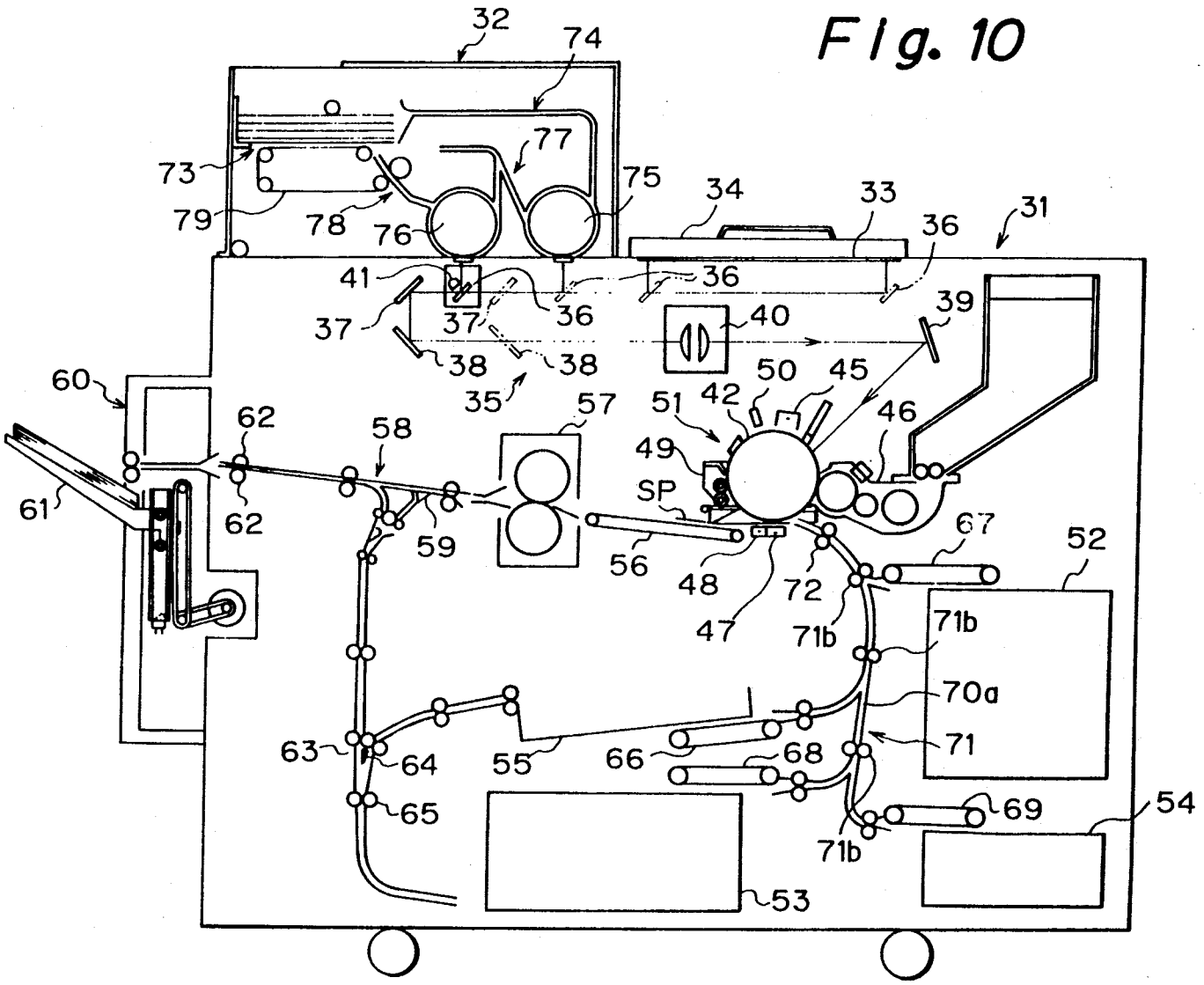
FIG. 10 is a schematic block diagram showing a copying machine according to an embodiment of the present invention.

Then, as shown in FIG. 6C, the copying sheet P1 is ejected to the paper tray 61. At the mode for copying a one-side subject copy to both sides of each copying sheet, for the light scanning, only the light scanning window 44 on the side of the rotary drum 76 is used. (The light scanning window 43 is used at the mode for copying a double-side subject copy.)

Next, when the fourth subject copy D4 one-previous to the final page is passed through the rotary drum 46, the light scanning is done on the subject copy D4 so that the image I4 is copied on the second copying sheet P2 fed from the paper cassette 52.

Figure 17:
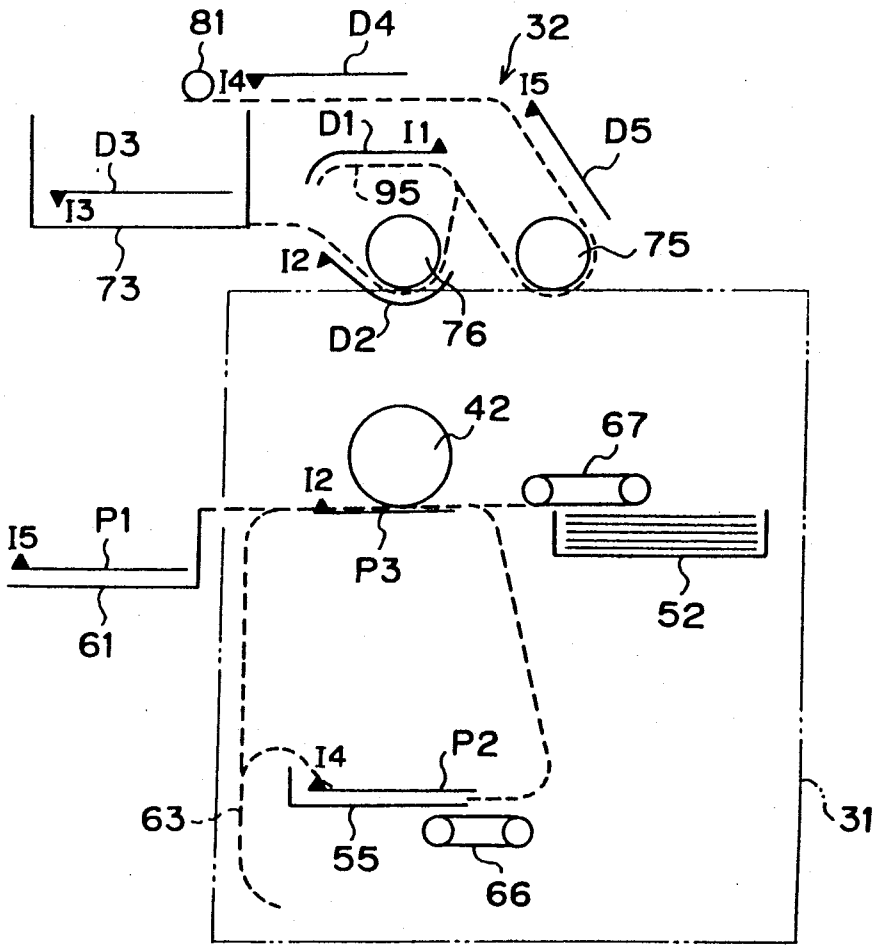
Figure 16:
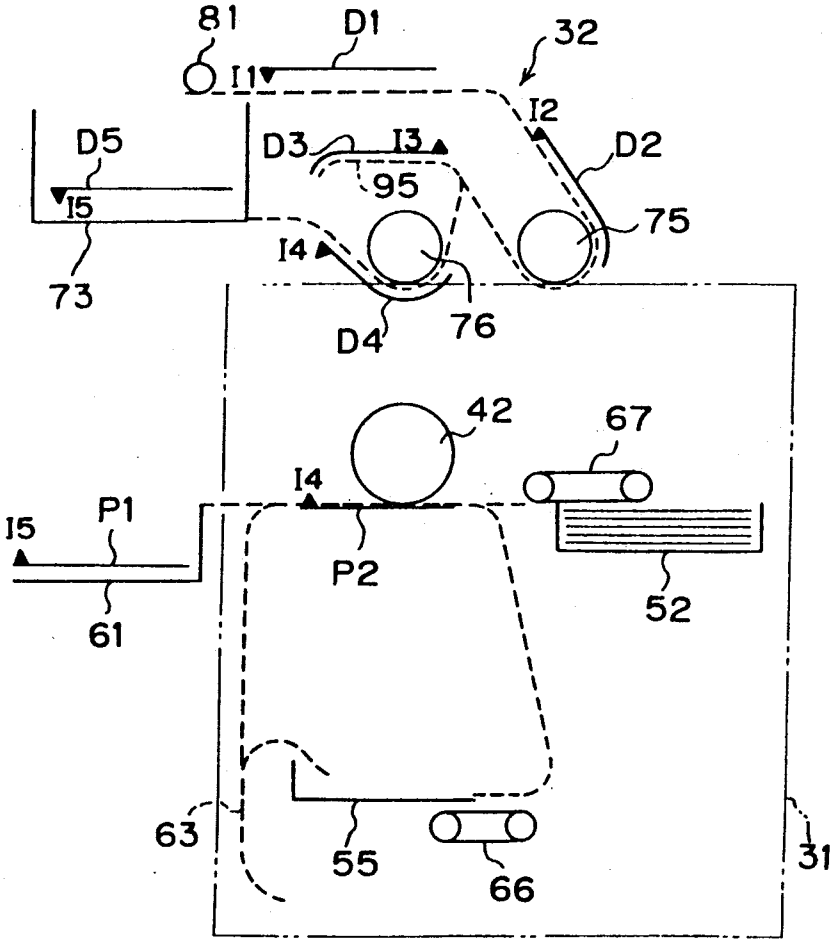

The copying sheet P2 is then fed to the middle tray 55 and is ejected to the middle tray 55 in a manner to direct the image I4 downward (see FIG. 17). In the meantime, the third subject copy D3 is passed through the rotary drum 76, but no light scanning is done on the third subject copy D3, because the third subject copy is not copied in the first circulation. That is, the third subject copy is skipped.

When the second subject copy D2 is passed through the rotary drum 76, the light scanning is done on the second subject copy so that the image I2 is copied on the third copying sheet P3. The resulting copying sheet P3 is ejected to the middle tray 55 in a manner that the copying sheet P3 is placed on the copying sheet P2 (see FIG. 18).

When the copying of the second subject copy D2 is completed, the paper-feeding source is switched. That is, an air feeding system is switched from the feeding belt 67 to the feed-out belt 66. When the switching is terminated, through the effect of the feed-out belt 66, the copying sheet P2 is fed out to the photosensitive drum 42. The copying sheet P2 is stored at the lowermost location of the middle tray 55.

It takes a considerably long time in switching the air feeding system and feeding the copying sheet P2 to the photosensitive drum 12 after being switched. According to the present embodiment, however, after copying the subject copy D2, the subject copy D1 is skipped at the first circulation without being copied. Further, after the subject copies are started to be circulated at the second circulation, the subject copies D5 and D4 are skipped without being copied, because those subject copies D5 and D4 have been already copied at the first circulation. It results in needing a sufficiently long interruption in feeding the subject copy D3 to the rotary drum 76. Hence, according to the present embodiment, at the second circulation of the subject copies, it is possible to feed the copying sheet P2 fed from the middle tray 55 to the photosensitive drum 42 until the subject copy D3 reaches the rotary drum 76. Hence, it is not necessary to temporarily stop the circulation of the subject copies when the paper-feeding source is switched.

Figure 19:
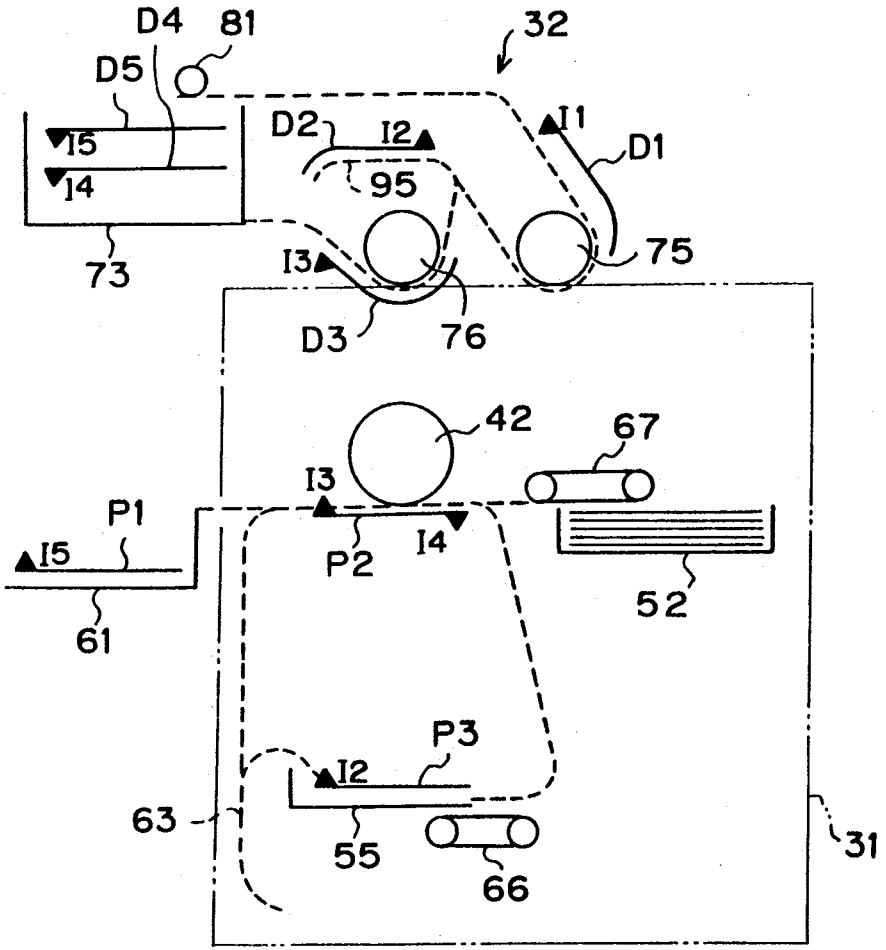
Figure 18:
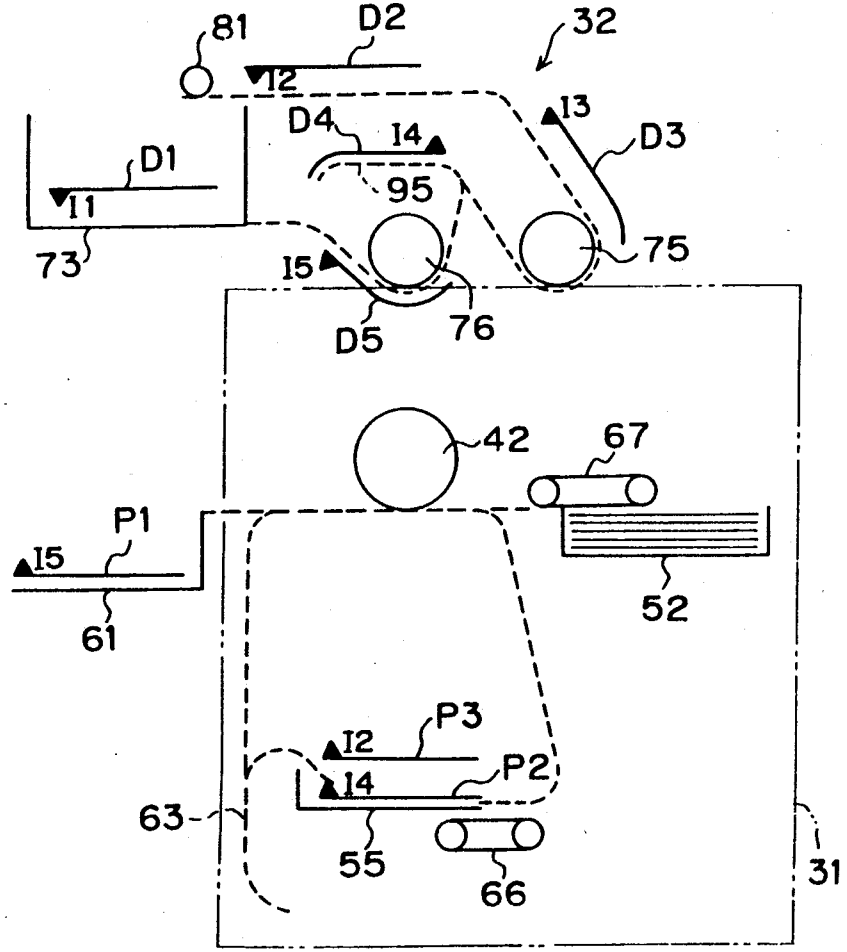

As shown in FIG. 19, at the second circulation of the subject copies, when the subject copy D3 reaches the rotary drum 76, the light is applied on the subject copy D3 for scanning so that the image I3 is copied on the non-use side of the copying sheet P2. Then, the resulting copying sheet P2 is ejected to the paper tray 61 (see FIG. 20). This copying sheet P2 has images copied on both sides.

Figure 21:
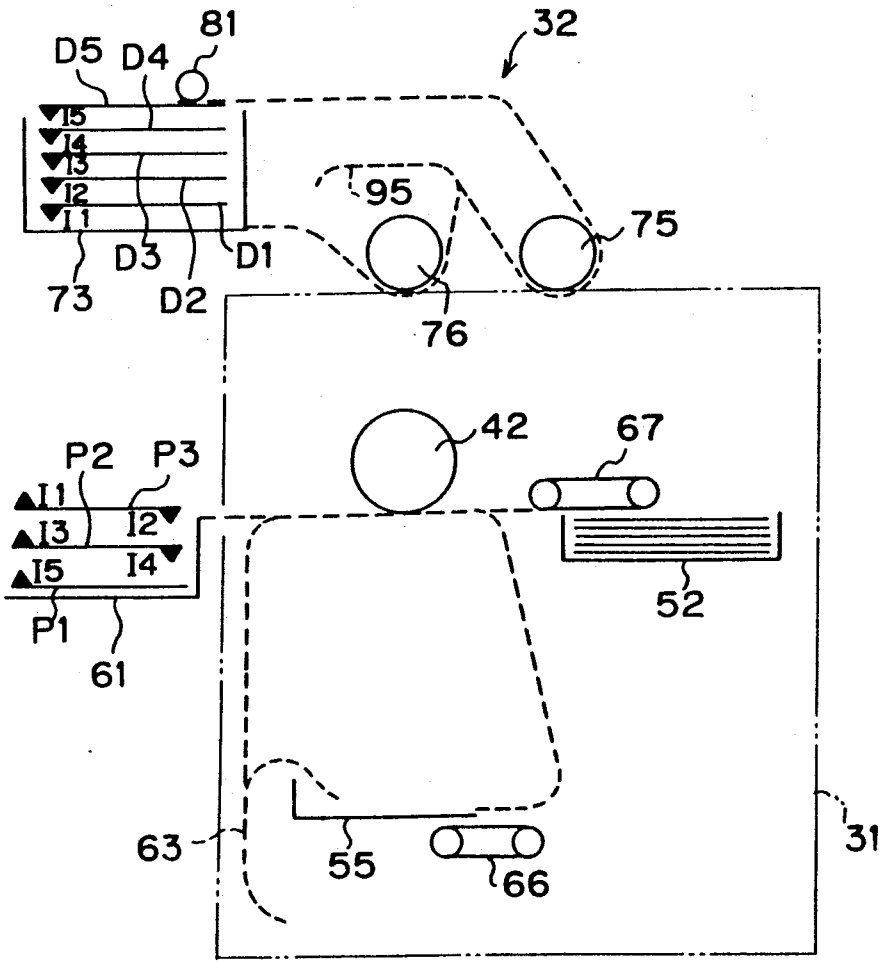
Figure 20:
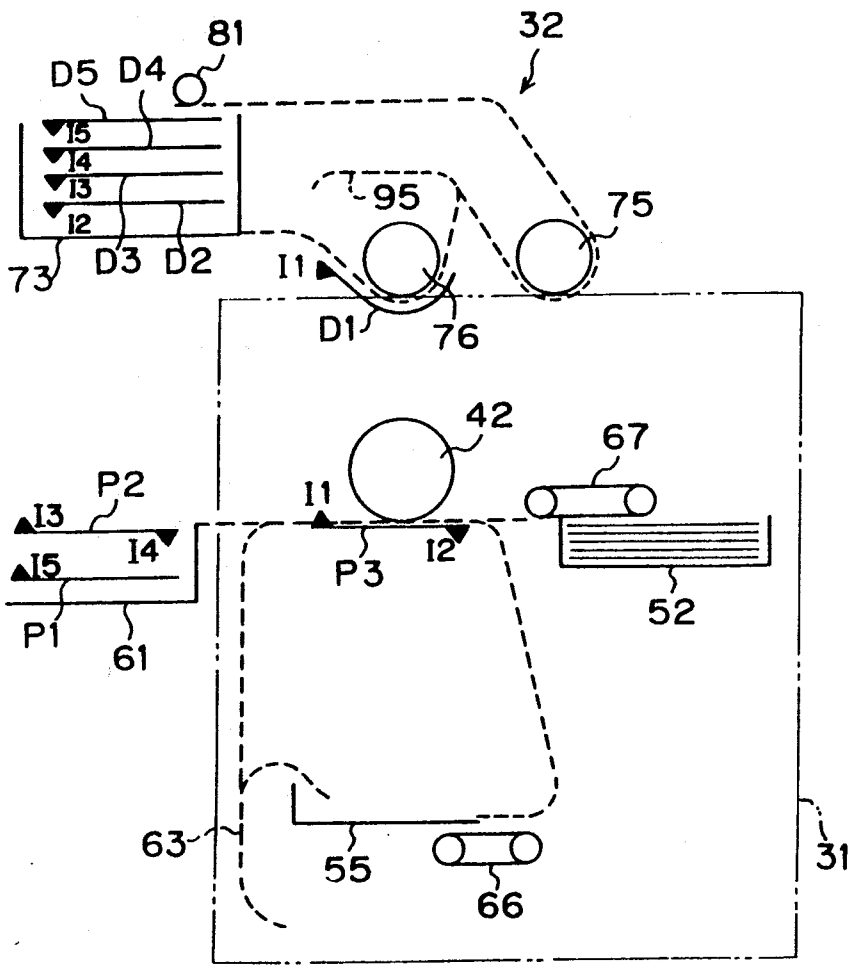
Figure 23:
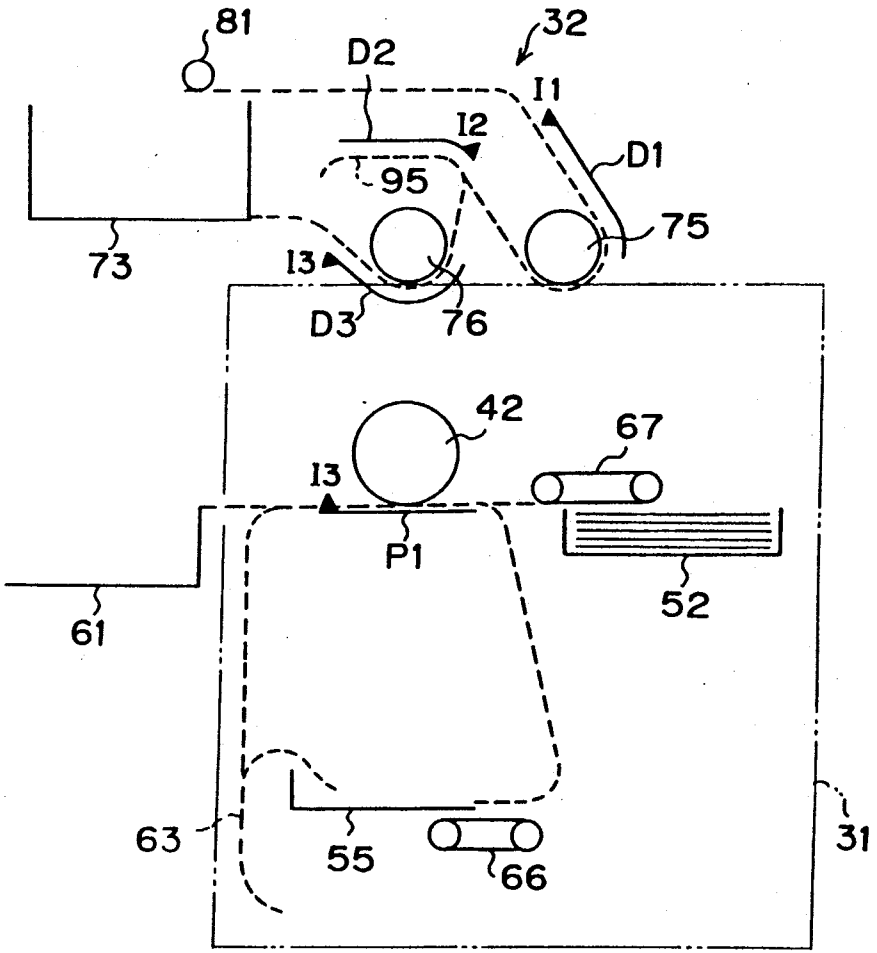
FIGS. 22 to 27 are explanatory views showing the process for copying one-side subject copies by using the double sides of the copying sheets if the number of the subject copies is 3 according to the present invention.

In the meantime, the second subject copy D2 is passed through the rotary drum 76. The subject copy D2 is, however, skipped without being copied, because the subject copy D2 has been already copied at the first circulation. Then, the subject copy D2 is returned to the subject-copy platform 73. When the first subject copy D1 reaches the rotary drum 76, the copying sheet P3 is fed from the middle tray 55 to the photosensitive drum 42 accordingly. The image of the subject copy D1 is copied on the non-use side of the copying sheet P3. As shown in FIG. 21, the copying sheet P3 is ejected to the paper tray 61, while the subject copy D1 is returned to the subject-copy platform 73.

By the foregoing process, all the subject copies have been copied while those subject copies are circulated twice. According to the present embodiment, when the paper-feeding source is switched from the paper cassette 52 to the middle tray 55, it is not necessary to interrupt the circulation of the subject copies D5 to D1, resulting in reducing the necessary time for copying all the subject copies.

The foregoing description has been expanded on the assumption that the number of the subject copies is 5. However, the foregoing description is true to seven or more subject copies if the number is odd. Assuming that the number of the subject copies is 7, at the first circulation of the subject copies, the seventh, the sixth, the fourth, and the second pages are sequentially copied. After switching the paper-feeding source, during the second circulation of the subject copies, the fifth, the third, and the first pages are sequentially copied. Like the foregoing description about the five subject copies, after starting the switching operation of the paper-feeding source, no light is applied to the first, the seventh and the sixth subject copies D1, D7 and D6 passed under the lower portion of the rotary drum 76, that is, through the light scanning location. It means that while the subject copies D1, D7 and D6 are skipped, it is possible to positively terminate the switching of the paper-feeding source and the feeding of papers from the middle tray 55.

In a case that the number of the subject copies is 3 when copying the one-side subject copy by using the both side of each copying sheet, for reducing the necessary copying time, it is also possible to set the time of the circulation of the subject copies as twice, copy the third and the second subject copies at the first circulation, and copy the first subject copy at the second circulation, whereas the known copying machine serves to copy the second subject copy at the first circulation and the third and the first subject copies at the second circulation. However, there exists a process for reducing the necessary copying time, which will be described later.

Figure 22:
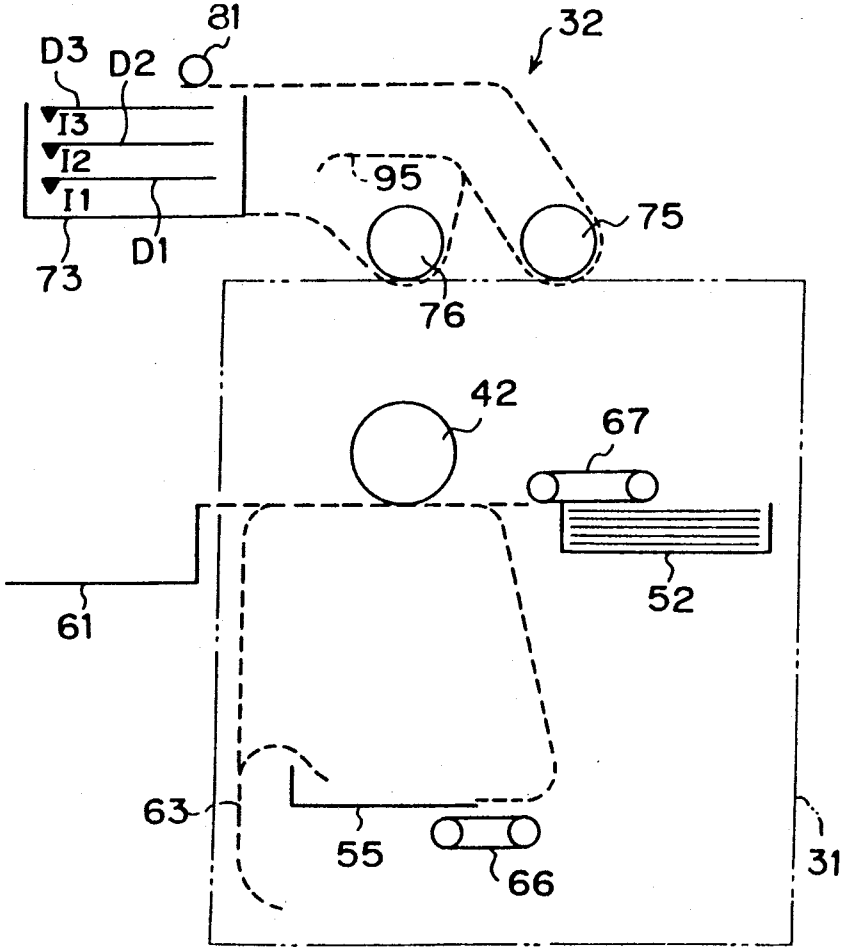

As shown in FIG. 22, in case the number of the subject copies is 3, those subject copies D1 to D3 are placed on the subject-copy platform 11 in a manner to locate the final page at the uppermost location.

Starting the copying operation, the subject copies D3, D2 and D1 are sequentially fed out from the subject-copy platform 11 and the copying sheets are sequentially fed from any one of the paper cassettes 52 to 54, for example, the paper cassette 52 to the photosensitive drum 42. And, when the subject copy D3 reaches the rotary drum 76, the image I3 of the subject copy D3 is copied on the first copying sheet P1 (see FIG. 22).

Figure 24:
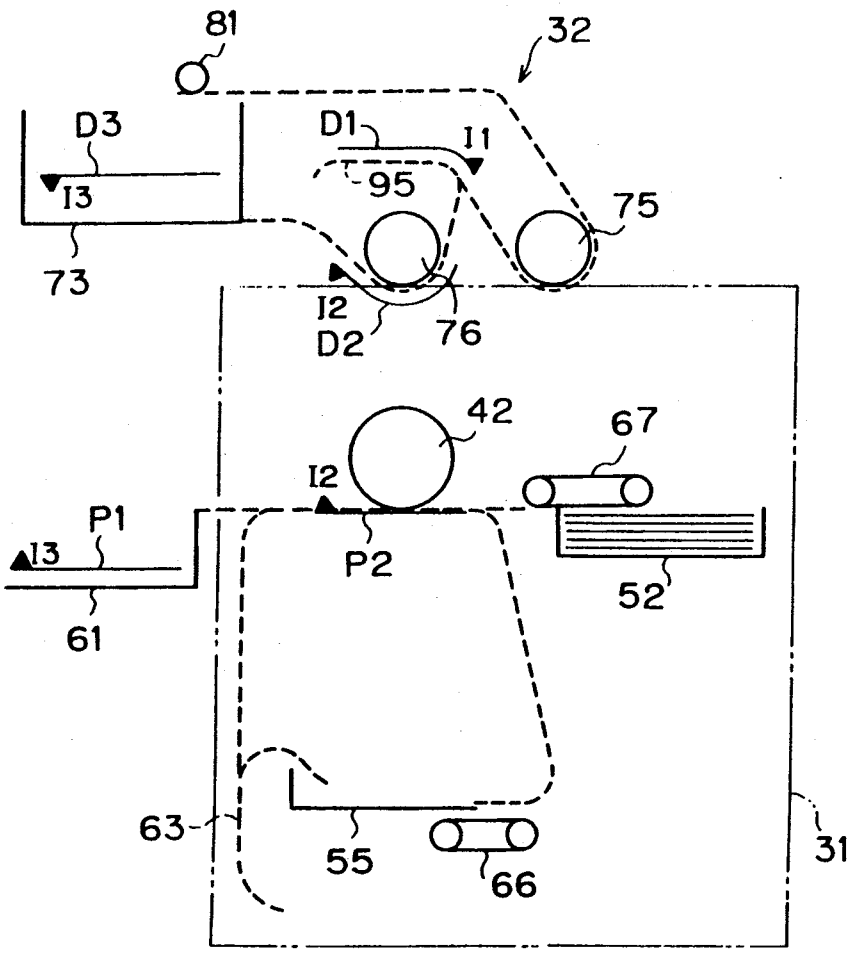

The subject copy D3 is returned to the subject-copy platform 73, while the copying sheet P1 is ejected to the paper tray 61 (see FIG. 24).

Figure 25:
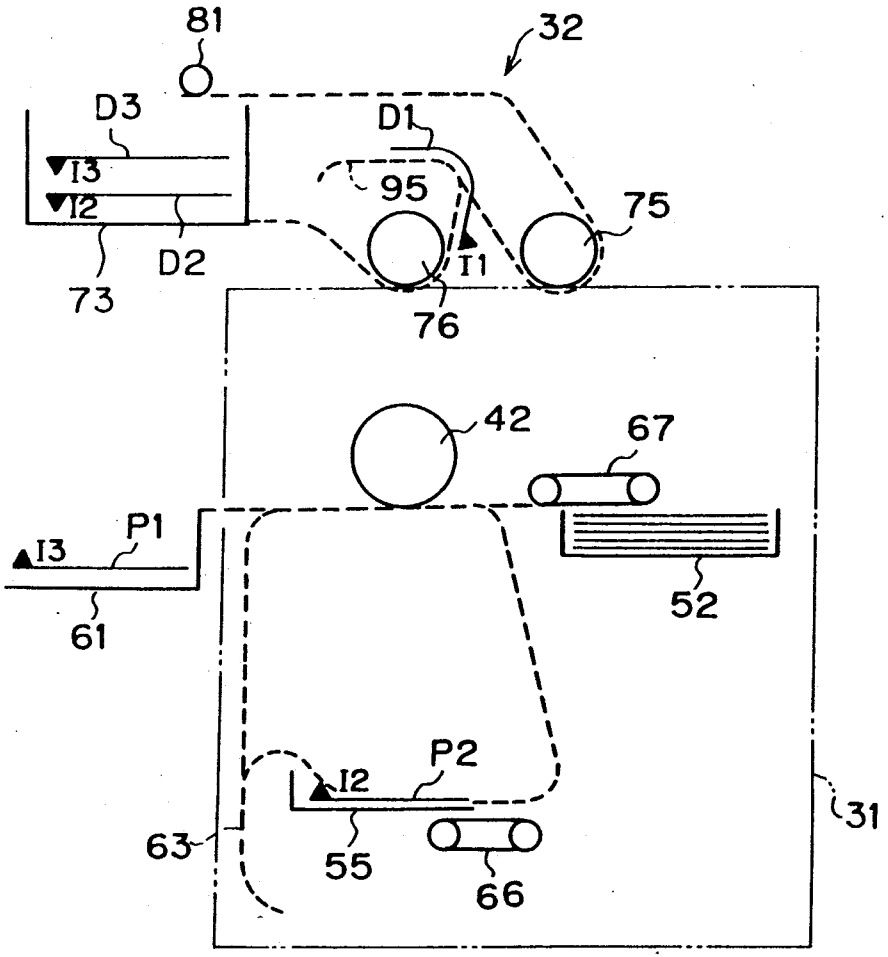

Then, when the subject copy D2 reaches the rotary drum 76, the subject copy D2 is copied on the second copying sheet and then the subject copy D2 is returned to the subject-copy platform 73, while the resulting copying sheet P2 is sent to the middle tray 55 (see FIG. 25).

The copying sheets P2 are immediately fed from the middle tray 55 to the photosensitive drum 42 through the effect of the feed-out belt 66 in a reversed manner. In the meantime, the subject copy D1 is waiting before the rotary drum 76 if necessary (see FIG. 26).

The reversed copying sheet P2 is fed to the photosensitive drum 42, where the image I1 of the subject copy D1 is copied on the non-use side of the copying sheet P2. Then, the subject copy D1 is returned to the subject-copy platform 73, while the resulting copying sheet P2 is ejected to the paper tray 61.

Figure 27:
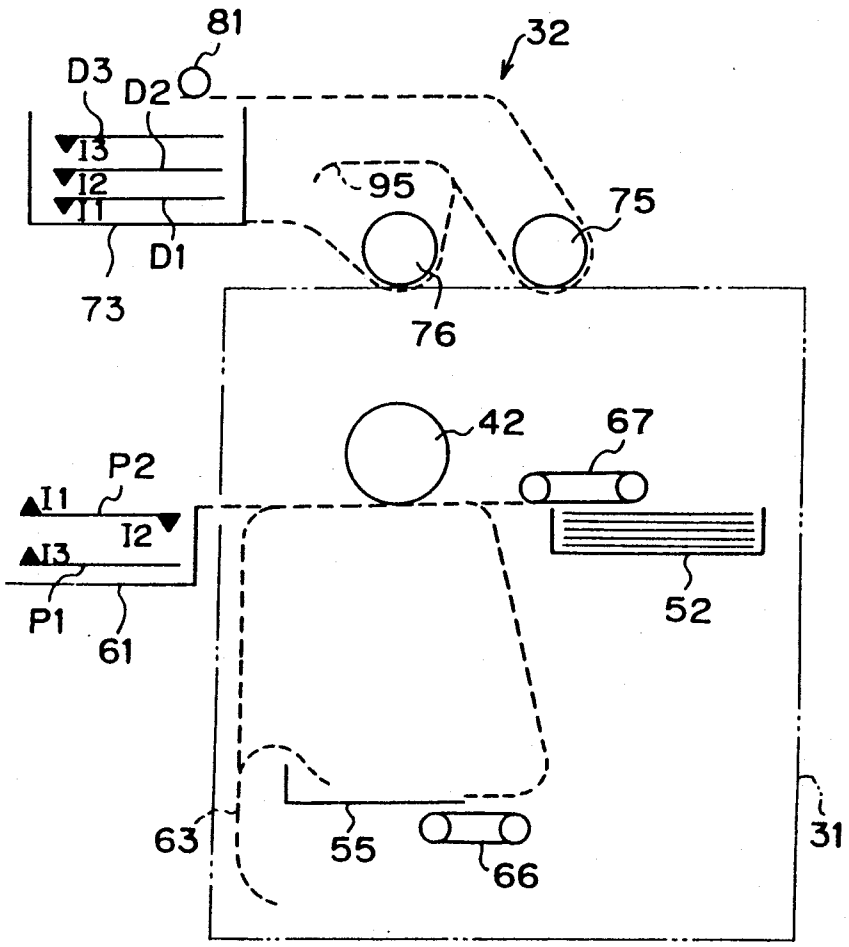
Figure 26:
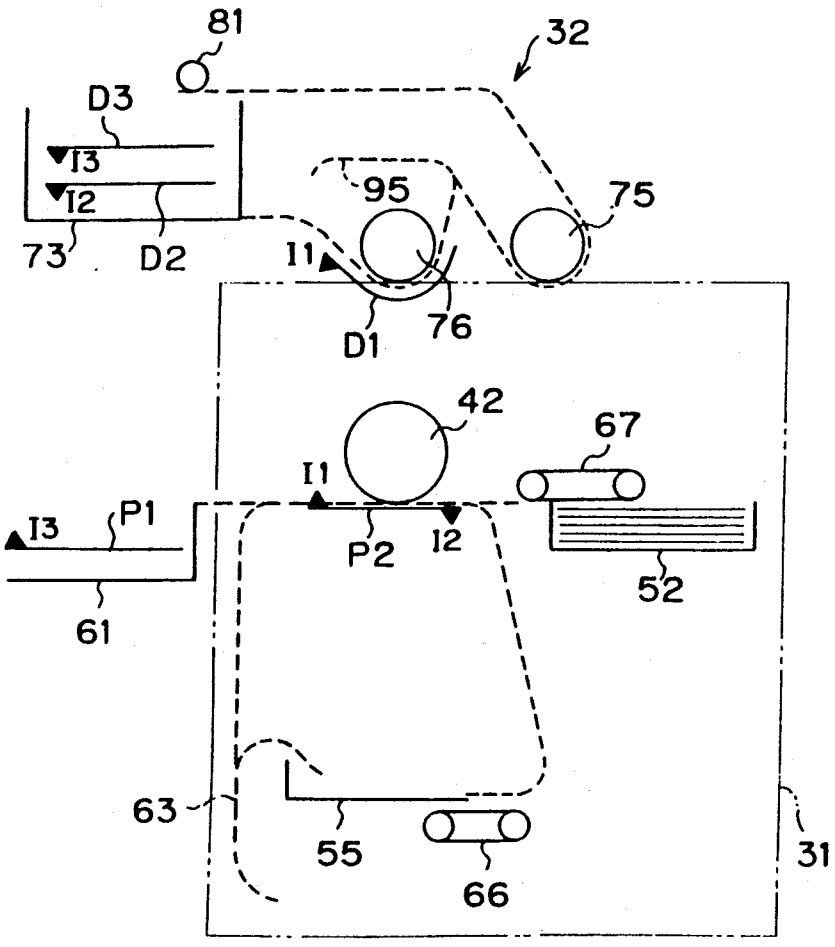

It means that all the subject copies have been copied (see FIG. 27).

In a case that the number of the copying sheets is 3, the foregoing process for completing the overall copying at one circulation results in greatly reducing the necessary copying time.

Many widely different embodiments of the present invention may be constructed without departing from the spirit and scope of the present invention. It should be understood that the present invention is not limited to the specific embodiments described in the specification, except as defined in the appended claims.

What is claimed is:

1. A copying machine which is capable of continuously copying two or more simplex original documents on both sides of copying sheets, said copying machine having an exposure scanning means for scanning said simplex original documents, said copying machine comprising:

means for circulatorily delivering a plurality of simplex original documents successively through an exposure scanning location of said exposure scanning means from a final page to a first page in a first circulation followed by a second circulation from the final page to the first page;

copy processing means for copying an image of each of said simplex original documents scanned by said exposure scanning means onto a copying sheet;

means for feeding blank copying sheets from a supply of said blank copying sheets to said copy processing means during the first circulation of simplex original documents;

means, receiving copying sheets from said copy processing means, for reversing said copying sheets having images formed by said copy processing means on one side thereof;

means for refeeding said reversed copying sheets to said copy processing means during the second circulation of simplex original documents; and means for controlling said copy processing means, when said plurality of simplex original documents equals a predetermined odd number of simplex original documents, so as to copy the final page, a page one previous to the final page and every other page following the page one previous to the final page in the first circulation and to copy a page two previous to the final page and every other page following the page two previous to the final page in the second circulation.

2. A copying machine according to claim 1, wherein said control means includes a microcomputer for controlling said passing means in an interlocking manner.

3. A copying machine according to claim 2, wherein said microcomputer is a central processing unit.

4. A copying machine according to claim 2, wherein said control means includes a plurality of sensors for counting said simplex original documents.

5. A copying machine according to claim 1, wherein said circulatorily delivering means is a rotary drum housing.

6. A copying machine according to claim 1 further comprising one or more paper cassettes for holding said supply of blank copying sheets.

7. A copying machine according to claim 1, wherein said re-feeding means comprises a middle tray.

8. The copying machine of claim 1 wherein said control means further includes means for ejecting a copying sheet having said final page copied thereon in the first circulation when said plurality of simplex original documents equals a predetermined odd number of simplex original documents.

9. A copying machine which is capable of continuously copying two or more simplex original documents on both sides of copying sheets, and copying machine having an exposure scanning means for scanning said simplex original documents, said copying machine further having a circulatory document delivering means for circulatory delivering a plurality of simplex original documents of said exposure scanning means, said copying machine comprising:

means for passing two or more copying sheets through a copy processing part of said copy processing means;

means disposed in said passing means for feeding said copying sheets to said copy processing means;

means coupled to said passing means for reversing said copying sheets having images formed by said copy processing means on said one side thereof;

means coupled to said passing means for refeeding said reversed copying sheets to said copy processing means;

means connected to said passing means for detecting a number of said copying sheets; and means connected to said passing means for controlling said passing means in a manner that after a final page of said simplex original documents passes through an exposure scanning location of said exposure scanning means, a first group of said simplex original documents copies and pass through said exposure scanning location at a first circulation and a second group of said simplex original documents copies and pass through said exposure scanning location at second circulation sequentially in accordance with sand number detected by said detecting means, said control means including means for sequentially copying a final page of said simplex original documents, followed by a preceding page with respect to said final page of said simplex original documents, and every other pages of said simplex original documents on said copying sheets fed from said feeding mean, at a first circulation in case that said number detected by said detecting means is represented by an odd number.

10. A copying machine according to claim 9, wherein said control means includes means for ejecting a copying sheet having said final page copied thereon at said first circulation in case that said number detected by said detecting means is represented by an odd number.

11. A copying machine according to claim 10, wherein said control means includes means for storing each copying sheet having the other simplex original documents which are copied on one side thereof in said refeeding means at said first circulation in case that said number detected by said detecting means is represented by an odd number.

12. A copying machine according to claim 11, wherein said control means includes means for copying not-copied simplex original documents on each non-use side of copying sheets fed from said refeeding means at a second circulation in case that said number detected by said detecting is represented by an odd number.

13. A copying machine which is capable of continuously copying two or more simplex original documents on both sides of copying sheets, said copying machine having an exposure scanning means for scanning said simplex original documents, said copying machine further having a circulatory document delivering means for circulatory delivering a plurality of simplex original documents to said exposure scanning means in sequence, said copying machine furthermore having a copy processing means for copying an image of each of said simplex original documents scanned by said exposure scanning means, said copying machine comprising:

means for passing two or more copying sheets through a copy processing part of said copy processing means;

means disposed in said passing means for feeding said copying sheets to said copy processing means;

means coupled to said passing means for reversing said copying sheets having images formed by said copy processing means on said one side thereof;

means coupled to said passing means for refeeding said reversed copying sheets to said copy processing means;

means connected to said passing means for detecting a number of said copying sheets; and means connected to said passing means for controlling said passing means in a manner that after a final page of said simplex original documents passes through an exposure scanning location of said exposure scanning means, a first group of said simplex original documents copies and pass through said exposure scanning location at a first circulation and a second group of said simplex original documents copies and pass through said exposure scanning location at second circulation sequentially in accordance with sand number detected by said detecting means, said control means including means for copying said final page of said simplex original documents and every other pages of said simplex original documents following said final copy on said copying sheets fed from said feeding means at said first circulation in case that said number detecting by said detecting means is represented by an even number.

14. A copying machine according to claim 13, wherein said control means includes means for storing said resulted copying sheets in said refeeding means at said first circulation in case that said number detected by said detecting means is represented by an even number.

15. A copying machine according to claim 14, wherein said control means includes means for copying said not-copied simplex original documents on each said non-use side of said copying sheets fed from said refeeding means at said second circulation in case that said number detected by said detecting means is represented by an even number.

16. A copying machine which is capable of continuously copying two or more simplex original documents on both sides of copying sheets, and copying machine having an exposure scanning means for scanning said simplex original documents, said copying machine further having a circulatory document delivering means for circulatory delivering a plurality of simplex original documents to said exposure scanning means in sequence, said copying machine furthermore having a copy processing means for copying an image of each of said simplex original documents scanned by said exposure scanning means, said copying machine comprising:

means for passing two or more copying sheets through a copy processing part of said copy processing means;

means disposed in said passing means for feeding said copying sheets to said copy processing means;

means coupled to said passing means for reversing said copying sheets having images formed by said copy processing means on said one side thereof;

means coupled to said passing means for refeeding said reversed copying sheets to said copy processing means;

means connected to said passing means for detecting a number of said copying sheets; and means connected to said passing means for controlling said passing means in a manner that after a final page of said simplex original documents passes through an exposure scanning location of said exposure scanning means, a first group of said simplex original documents copies and pass through said exposure scanning location at a first circulation and a second group of said simplex original documents copies and pass through said exposure scanning location at second circulation sequentially in accordance with sand number detected by said detecting means, said control means being adapted to control a passage of said simplex original documents so that all of said simplex original documents are copied on both sides of said copying sheets at one circulation in case that said numbers of said simplex original documents are three.

* * * * *